US010408010B2

(12) United States Patent
Orban

(10) Patent No.: US 10,408,010 B2
(45) Date of Patent: Sep. 10, 2019

(54) PIPE RAM ASSEMBLY FOR MANY ACTUATION CYCLES

(71) Applicant: SCHLUMBERGER TECHNOLOGY CORPORATON, Sugar Land, TX (US)

(72) Inventor: Jacques Orban, Katy, TX (US)

(73) Assignee: SCHLUMBERGER TECHNOLOGY CORPORATON, Sugar Land, TX (US)

( * ) Notice: Subject to any disclaimer, the term of this patent is extended or adjusted under 35 U.S.C. 154(b) by 239 days.

(21) Appl. No.: 15/287,945

(22) Filed: Oct. 7, 2016

(65) Prior Publication Data

US 2017/0159393 A1 Jun. 8, 2017

Related U.S. Application Data

(60) Provisional application No. 62/264,517, filed on Dec. 8, 2015.

(51) Int. Cl.

| | |
|---|---|
| ***E21B 33/06*** | (2006.01) |
| ***E21B 19/16*** | (2006.01) |
| ***E21B 47/06*** | (2012.01) |
| ***E21B 47/10*** | (2012.01) |
| ***E21B 21/08*** | (2006.01) |
| ***E21B 33/03*** | (2006.01) |
| *E21B 33/08* | (2006.01) |

(52) U.S. Cl.

CPC ..... *E21B 33/062* (2013.01); *E21B 19/16* (2013.01); *E21B 21/08* (2013.01); *E21B 33/03* (2013.01); *E21B 47/06* (2013.01); *E21B 47/065* (2013.01); *E21B 47/10* (2013.01); *E21B 33/085* (2013.01)

(58) Field of Classification Search

CPC ..... E21B 33/062; E21B 33/061; E21B 19/16; E21B 47/10; E21B 21/08; E21B 33/06

See application file for complete search history.

(56) References Cited

U.S. PATENT DOCUMENTS

| | | | |
|---|---|---|---|
| 3,822,902 | A | 7/1974 | Maurer et al. |
| 5,212,885 | A | 5/1993 | Buonodono et al. |
| 6,591,916 | B1 | 7/2003 | Ayling |
| 6,803,757 | B2 | 10/2004 | Slates |

(Continued)

FOREIGN PATENT DOCUMENTS

WO 2002036928 A1 5/2002

*Primary Examiner* — Catherine Loikith

(74) *Attorney, Agent, or Firm* — Rachel E. Greene

(57) ABSTRACT

A blowout preventer and a method for drilling, of which the blowout preventer includes a body defining a ram recess and an annular recess, the ram recess and the annular recess being separated apart. The blowout preventer also includes a ram positioned at least partially in the ram recess and movable with respect to the body, the ram having a distal end configured to engage a tubular and a proximal end positioned within the first recess. The blowout preventer further includes an actuation assembly including an actuation chamber, the annular recess being positioned between the actuation chamber and the ram recess. The blowout preventer also includes a buffer supply system configured to circulate a fluid through the annular recess, to prevent leakage of fluid from the ram recess into the actuation chamber.

13 Claims, 15 Drawing Sheets

(56) References Cited

U.S. PATENT DOCUMENTS

| | | | | |
|---|---|---|---|---|
| 8,511,389 | B2 * | 8/2013 | Fenton | E21B 33/0385 166/368 |
| 2002/0157838 | A1 | 10/2002 | Ayling | |
| 2004/0174163 | A1 | 9/2004 | Rogers et al. | |
| 2007/0017682 | A1 | 1/2007 | Abrahamsen et al. | |
| 2007/0240875 | A1 | 10/2007 | Van Riet et al. | |
| 2009/0151934 | A1 | 6/2009 | Heidecke et al. | |
| 2011/0174500 | A1 | 7/2011 | Davies et al. | |
| 2013/0283917 | A1 * | 10/2013 | Coonrod | E21B 33/061 73/597 |
| 2014/0124267 | A1 | 5/2014 | Ayling | |
| 2014/0202767 | A1 | 7/2014 | Feasey | |
| 2014/0231073 | A1 | 8/2014 | Teodorescu et al. | |
| 2014/0262510 | A1 | 9/2014 | Beddoes et al. | |
| 2015/0191977 | A1 | 7/2015 | Skjaerseth et al. | |
| 2016/0002984 | A1 | 1/2016 | Grice | |

* cited by examiner

PIPE RAM ASSEMBLY FOR MANY ACTUATION CYCLES

CROSS-REFERENCE TO RELATED APPLICATIONS

This application claims priority to U.S. Provisional Patent Application Ser. No. 62/264,517, which was filed on Dec. 8, 2015 and is incorporated herein by reference in its entirety.

BACKGROUND

During drilling operations, drilling mud may be pumped into the wellbore. The drilling mud may serve several purposes, including applying a pressure on the formation, which may reduce or prevent formation fluids from entering the wellbore during drilling. For various reasons, sufficient the pressure in wellbore may not be maintained or achieved. When this happens, the formation fluid may enter in the wellbore and mix with drilling fluid. The formation influx fluid commonly has a lower density than the drilling fluid; thus, the hydrostatic pressure in the well is further reduced by the influx of the formation fluid, resulting in an increase in the rate at which the formation fluid flows into the wellbore.

Eventually, the formation fluids mixed with the drilling fluid may reach the surface, resulting in a risk of fire or explosion if hydrocarbon (liquid or gas) is contained in the formation fluid. To control this risk, pressure control devices are installed at surface. For example, the blowout preventer (BOP) may be attached onto the wellhead and a rotary control device (RCD) may be attached on the top of the BOP to avoid the influx fluid reaching the rig floor, as well as allowing pressure management inside the wellbore.

The BOP and/or RCD may include seals to control fluid flow from the wellbore. The seals may include elastomeric elements, which are typically pressed between two rigid (metal) surfaces, e.g., between a pipe ram and a pipe, to form a seal. The wear rate of the elastomeric elements, and/or of the metallic surfaces, may increase during use, based on a variety of factors such as particulates in the environment, the roughness of the metal surface, pressure differential across the seal, etc. Accordingly, the pipe ram seals are often considered a safety mechanism, useful for at most a few actuations, after which the pipe ram seals are typically replaced.

Furthermore, during drilling process, some drill pipe connections at the top of the drill string may be broken, to add or remove drill pipe in the drill string. When the connection between two pipes, or between the top drive and a pipe, is broken during trip-in or trip-out, the pumping of mud generally ceases while a new connection is made. Stopping the mud flow may risk the aforementioned loss of over-pressure and the risks of hazardous conditions that come with it. Further, cuttings may settle in the annulus between the drill string and the wellbore, which may increase the risk of stuck-pipe. Additionally, the filter cake at the bore wall may be affected with risk of additional invasion in some formations, which may reduce productivity along the reservoir, as well as creating a risk for wellbore instability. In addition, gas pressure may rise when the mud no longer circulates through the drill string. Thus, it may be desirable to maintain continuous circulation in the wellbore during the trip-in and trip-out processes.

SUMMARY

Embodiments of the disclosure may provide a blowout preventer including a body defining a ram recess and an annular recess, the ram recess and the annular recess being separated apart. The blowout preventer also includes a ram positioned at least partially in the ram recess and movable with respect to the body, the ram having a distal end configured to engage a tubular and a proximal end positioned within the first recess. The blowout preventer further includes an actuation assembly including an actuation chamber, the annular recess being positioned between the actuation chamber and the ram recess. The blowout preventer also includes a buffer supply system configured to circulate a fluid through the annular recess, to prevent leakage of fluid from the ram recess into the actuation chamber.

Embodiments of the disclosure may also provide a method for drilling. The method includes closing a pipe ram assembly in a blowout preventer by adjusting a pressure in an actuation chamber, such that a ram of the ram assembly moves into engagement with a drill string, and breaking a connection of the drill string within the blowout preventer. A weight of the drill string is supported by the pipe ram assembly after breaking the connection. The method also includes circulating drilling mud through the blowout preventer and the drill string, after breaking the connection, connecting a tubular to the connection of the drill string within the blowout preventer, and opening the pipe ram assembly such that the ram retracts away from the drill string.

Embodiments of the disclosure may further provide a blowout preventer including a body defining a ram recess, and a ram. The ram is positioned at least partially in the ram recess and is movable with respect to the body. The ram includes a distal end configured to engage a tubular, a proximal end positioned within the ram recess, a first sealing element at the distal end that is configured to seal with the tubular, a high-pressure side and a low-pressure side that both extend between the proximal and distal ends, a second sealing element on the low pressure side that is configured to seal with the body in the recess, and a lift piston extending from the low-pressure side, wherein the lift piston is configured to push the low-pressure side of the ram away from the body in the ram recess.

It will be appreciated that the foregoing summary is provided merely to introduce a subset of the features of the present disclosure, which are described in greater detail, along with other aspects of the present disclosure, below. The foregoing summary is, therefore, not to be considered exhaustive or otherwise limiting.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Figure 1:
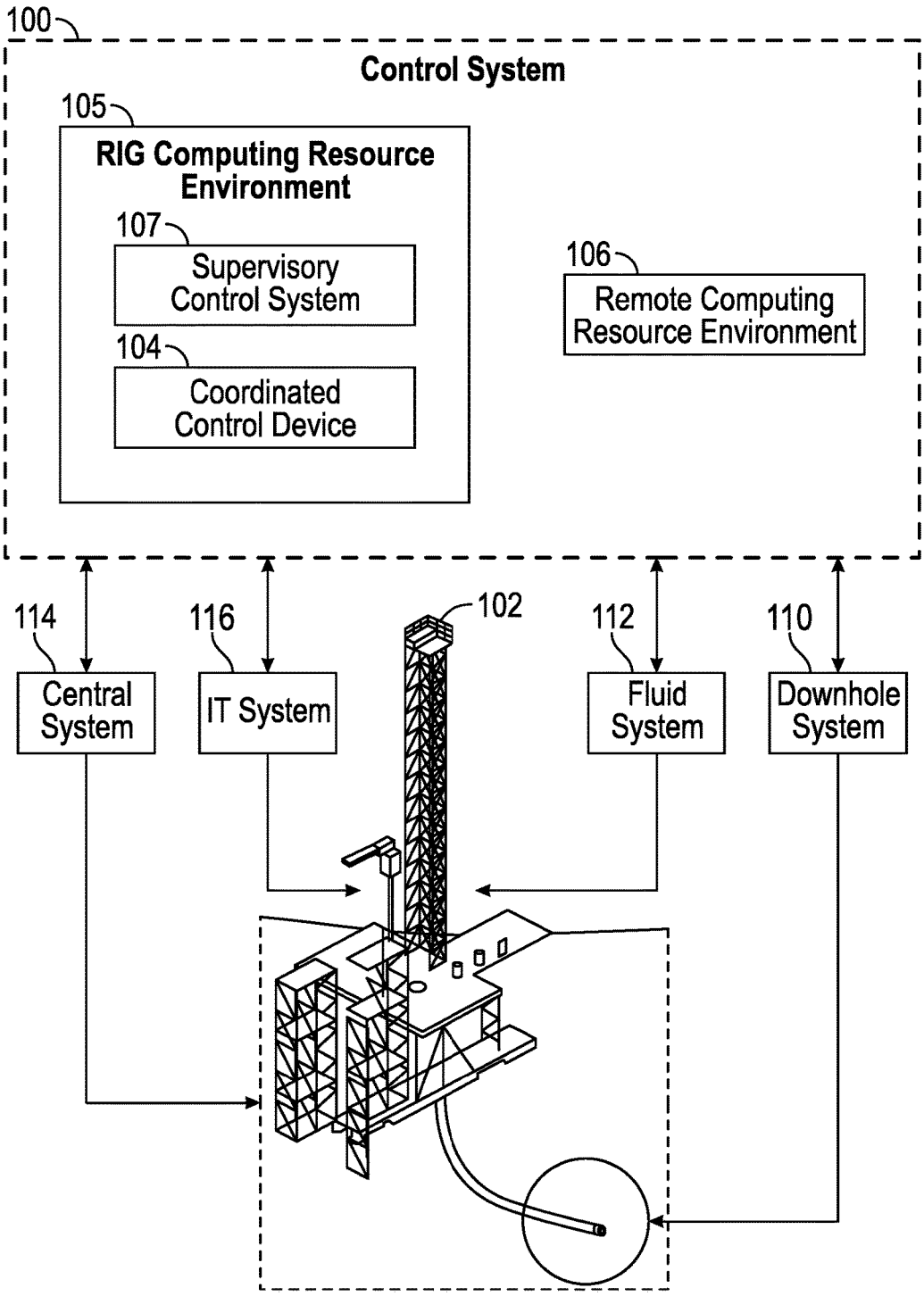
FIG. 1 illustrates a schematic view of a drilling rig and a control system, according to an embodiment.

In general, embodiments of the present disclosure may provide a pipe ram for use in a blowout preventer in a drilling rig system. Pipe rams are generally safety devices, which are generally intended to be used for few cycles (even in some case single time), e.g., in case of an emergency, and then replaced. In contrast, slips are used for many cycles, to support the weight of the drill string. However, in continuous mud flow applications, the drill string may be broken within the blowout preventer, and thus the slips at the rig floor, above the blowout preventer, may not be available to support the weight of the drill string. Accordingly, the present disclosure provides a "many-cycle" pipe ram, which may, in some embodiments, be employed in a similar manner as slips to repetitively support and release the drill string during tripping operations, while also sealing with the drill pipe. This many-cycle pipe ram may be within the blowout preventer, so as to allow for continuous mud circulation in the well via the blowout preventer.

Reference will now be made in detail to specific embodiments illustrated in the accompanying drawings and figures. In the following detailed description, numerous specific details are set forth in order to provide a thorough understanding of the invention. However, it will be apparent to one of ordinary skill in the art that embodiments may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object or step, and, similarly, a second object could be termed a first object or step, without departing from the scope of the present disclosure.

The terminology used in the description of the invention herein is for the purpose of describing particular embodiments only and is not intended to be limiting. As used in the description of the invention and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

FIG. 1 illustrates a conceptual, schematic view of a control system 100 for a drilling rig 102, according to an embodiment. The control system 100 may include a rig computing resource environment 105, which may be located onsite at the drilling rig 102 and, in some embodiments, may have a coordinated control device 104. The control system 100 may also provide a supervisory control system 107. In some embodiments, the control system 100 may include a remote computing resource environment 106, which may be located offsite from the drilling rig 102.

The remote computing resource environment 106 may include computing resources locating offsite from the drilling rig 102 and accessible over a network. A "cloud" computing environment is one example of a remote computing resource. The cloud computing environment may communicate with the rig computing resource environment 105 via a network connection (e.g., a WAN or LAN connection). In some embodiments, the remote computing resource environment 106 may be at least partially located onsite, e.g., allowing control of various aspects of the drilling rig 102 onsite through the remote computing resource environment 105 (e.g., via mobile devices). Accordingly, "remote" should not be limited to any particular distance away from the drilling rig 102.

Further, the drilling rig 102 may include various systems with different sensors and equipment for performing operations of the drilling rig 102, and may be monitored and controlled via the control system 100, e.g., the rig computing resource environment 105. Additionally, the rig computing resource environment 105 may provide for secured access to rig data to facilitate onsite and offsite user devices monitoring the rig, sending control processes to the rig, and the like.

Various example systems of the drilling rig 102 are depicted in FIG. 1. For example, the drilling rig 102 may include a downhole system 110, a fluid system 112, and a central system 114. These systems 110, 112, 114 may also be examples of "subsystems" of the drilling rig 102, as described herein. In some embodiments, the drilling rig 102 may include an information technology (IT) system 116. The downhole system 110 may include, for example, a bottomhole assembly (BHA), mud motors, sensors, etc. disposed along the drill string, and/or other drilling equipment configured to be deployed into the wellbore. Accordingly, the downhole system 110 may refer to tools disposed in the wellbore, e.g., as part of the drill string used to drill the well.

The fluid system 112 may include, for example, drilling mud, pumps, valves, cement, mud-loading equipment, mud-management equipment, pressure-management equipment, separators, and other fluids equipment. Accordingly, the fluid system 112 may perform fluid operations of the drilling rig 102.

The central system 114 may include a hoisting and rotating platform, top drives, rotary tables, kellys, drawworks, pumps, generators, tubular handling equipment, derricks, masts, substructures, and other suitable equipment. Accordingly, the central system 114 may perform power generation, hoisting, and rotating operations of the drilling rig 102, and serve as a support platform for drilling equipment and staging ground for rig operation, such as connection make up, etc. The IT system 116 may include software, computers, and other IT equipment for implementing IT operations of the drilling rig 102.

The control system 100, e.g., via the coordinated control device 104 of the rig computing resource environment 105, may monitor sensors from multiple systems of the drilling rig 102 and provide control commands to multiple systems of the drilling rig 102, such that sensor data from multiple systems may be used to provide control commands to the different systems of the drilling rig 102. For example, the system 100 may collect temporally and depth aligned surface data and downhole data from the drilling rig 102 and store the collected data for access onsite at the drilling rig 102 or offsite via the rig computing resource environment 105. Thus, the system 100 may provide monitoring capability. Additionally, the control system 100 may include supervisory control via the supervisory control system 107.

In some embodiments, one or more of the downhole system 110, fluid system 112, and/or central system 114 may be manufactured and/or operated by different vendors. In such an embodiment, certain systems may not be capable of unified control (e.g., due to different protocols, restrictions on control permissions, safety concerns for different control systems, etc.). An embodiment of the control system 100 that is unified, may, however, provide control over the drilling rig 102 and its related systems (e.g., the downhole system 110, fluid system 112, and/or central system 114, etc.). Further, the downhole system 110 may include one or a plurality of downhole systems. Likewise, fluid system 112, and central system 114 may contain one or a plurality of fluid systems and central systems, respectively.

In addition, the coordinated control device 104 may interact with the user device(s) (e.g., human-machine interface(s)) 118, 120. For example, the coordinated control device 104 may receive commands from the user devices 118, 120 and may execute the commands using two or more of the rig systems 110, 112, 114, e.g., such that the operation of the two or more rig systems 110, 112, 114 act in concert and/or off-design conditions in the rig systems 110, 112, 114 may be avoided.

Figure 2:
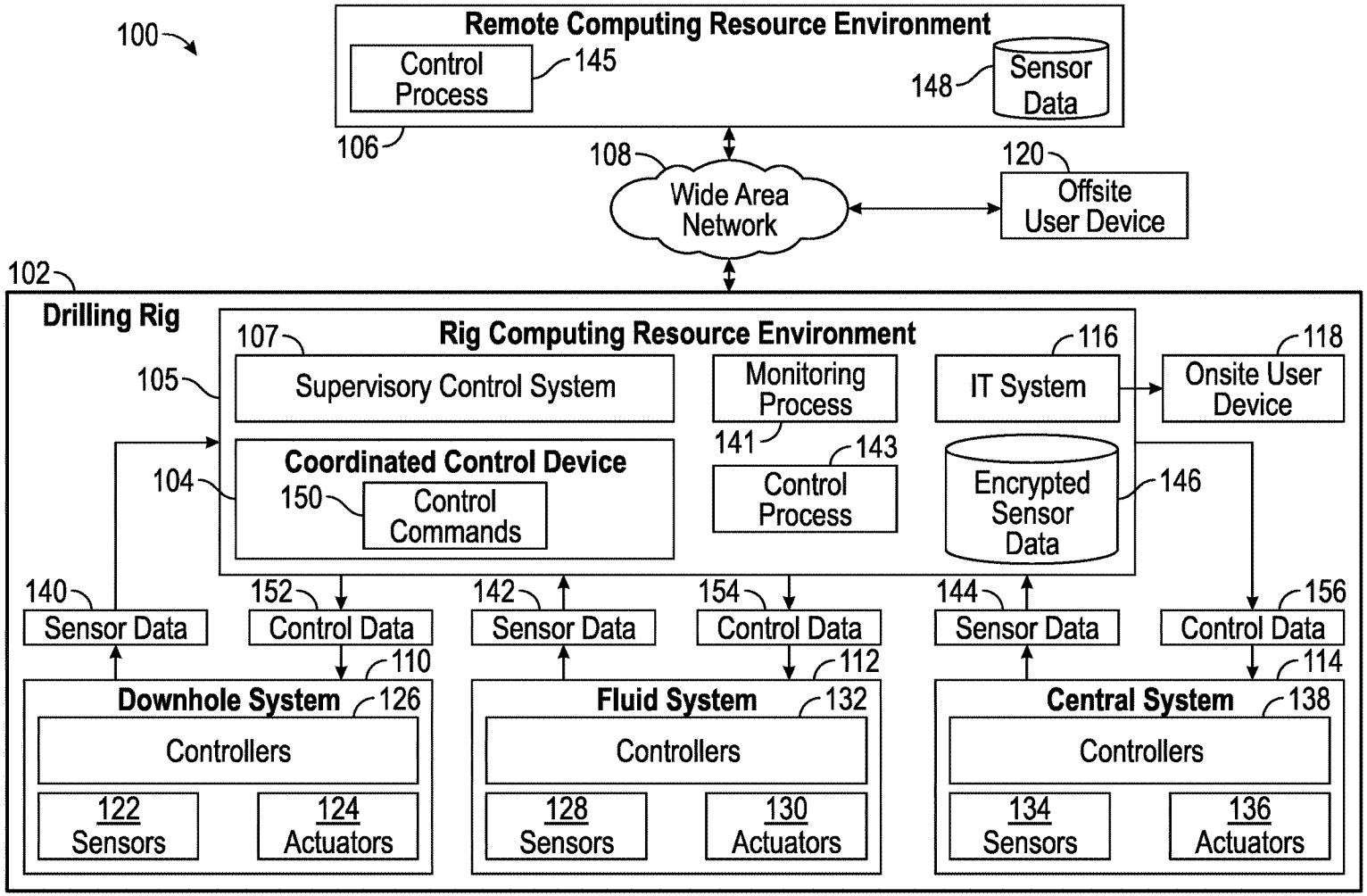
FIG. 2 illustrates a schematic view of a drilling rig and a remote computing resource environment, according to an embodiment.

FIG. 2 illustrates a conceptual, schematic view of the control system 100, according to an embodiment. The rig computing resource environment 105 may communicate with offsite devices and systems using a network 108 (e.g., a wide area network (WAN) such as the internet). Further, the rig computing resource environment 105 may communicate with the remote computing resource environment 106 via the network 108. FIG. 2 also depicts the aforementioned example systems of the drilling rig 102, such as the downhole system 110, the fluid system 112, the central system 114, and the IT system 116. In some embodiments, one or more onsite user devices 118 may also be included on the drilling rig 102. The onsite user devices 118 may interact with the IT system 116. The onsite user devices 118 may include any number of user devices, for example, stationary user devices intended to be stationed at the drilling rig 102 and/or portable user devices. In some embodiments, the onsite user devices 118 may include a desktop, a laptop, a smartphone, a personal data assistant (PDA), a tablet component, a wearable computer, or other suitable devices. In some embodiments, the onsite user devices 118 may communicate with the rig computing resource environment 105 of the drilling rig 102, the remote computing resource environment 106, or both.

One or more offsite user devices 120 may also be included in the system 100. The offsite user devices 120 may include a desktop, a laptop, a smartphone, a personal data assistant (PDA), a tablet component, a wearable computer, or other suitable devices. The offsite user devices 120 may be configured to receive and/or transmit information (e.g., monitoring functionality) from and/or to the drilling rig 102 via communication with the rig computing resource environment 105. In some embodiments, the offsite user devices 120 may provide control processes for controlling operation of the various systems of the drilling rig 102. In some embodiments, the offsite user devices 120 may communicate with the remote computing resource environment 106 via the network 108.

The user devices 118 and/or 120 may be examples of a human-machine interface. These devices 118, 120 may allow feedback from the various rig subsystems to be displayed and allow commands to be entered by the user. In various embodiments, such human-machine interfaces may be onsite or offsite, or both.

The systems of the drilling rig 102 may include various sensors, actuators, and controllers (e.g., programmable logic controllers (PLCs)), which may provide feedback for use in the rig computing resource environment 105. For example, the downhole system 110 may include sensors 122, actuators 124, and controllers 126. The fluid system 112 may include sensors 128, actuators 130, and controllers 132. Additionally, the central system 114 may include sensors 134, actuators 136, and controllers 138. The sensors 122, 128, and 134 may include any suitable sensors for operation of the drilling rig 102. In some embodiments, the sensors 122, 128, and 134 may include a camera, a pressure sensor, a temperature sensor, a flow rate sensor, a vibration sensor, a current sensor, a voltage sensor, a resistance sensor, a gesture detection sensor or device, a voice actuated or recognition device or sensor, or other suitable sensors.

The sensors described above may provide sensor data feedback to the rig computing resource environment 105 (e.g., to the coordinated control device 104). For example, downhole system sensors 122 may provide sensor data 140, the fluid system sensors 128 may provide sensor data 142, and the central system sensors 134 may provide sensor data 144. The sensor data 140, 142, and 144 may include, for example, equipment operation status (e.g., on or off, up or down, set or release, etc.), drilling parameters (e.g., depth, hook load, torque, etc.), auxiliary parameters (e.g., vibration data of a pump) and other suitable data. In some embodiments, the acquired sensor data may include or be associated with a timestamp (e.g., a date, time or both) indicating when the sensor data was acquired. Further, the sensor data may be aligned with a depth or other drilling parameter.

Acquiring the sensor data into the coordinated control device 104 may facilitate measurement of the same physical properties at different locations of the drilling rig 102. In some embodiments, measurement of the same physical properties may be used for measurement redundancy to enable continued operation of the well. In yet another embodiment, measurements of the same physical properties at different locations may be used for detecting equipment conditions among different physical locations. In yet another embodiment, measurements of the same physical properties using different sensors may provide information about the relative quality of each measurement, resulting in a "higher" quality measurement being used for rig control, and process applications. The variation in measurements at different locations over time may be used to determine equipment performance, system performance, scheduled maintenance due dates, and the like. Furthermore, aggregating sensor data from each subsystem into a centralized environment may enhance drilling process and efficiency. For example, slip status (e.g., in or out) may be acquired from the sensors and provided to the rig computing resource environment 105, which may be used to define a rig state for automated control. In another example, acquisition of fluid samples may be measured by a sensor and related with bit depth and time measured by other sensors. Acquisition of data from a camera sensor may facilitate detection of arrival and/or installation of materials or equipment in the drilling rig 102. The time of arrival and/or installation of materials or equipment may be used to evaluate degradation of a material, scheduled maintenance of equipment, and other evaluations.

The coordinated control device 104 may facilitate control of individual systems (e.g., the central system 114, the downhole system, or fluid system 112, etc.) at the level of each individual system. For example, in the fluid system 112, sensor data 128 may be fed into the controller 132, which may respond to control the actuators 130. However, for control operations that involve multiple systems, the control may be coordinated through the coordinated control device 104. Examples of such coordinated control operations include the control of downhole pressure during tripping. The downhole pressure may be affected by both the fluid system 112 (e.g., pump rate and choke position) and the central system 114 (e.g. tripping speed). When it is desired to maintain certain downhole pressure during tripping, the coordinated control device 104 may be used to direct the appropriate control commands. Furthermore, for mode based controllers which employ complex computation to reach a control setpoint, which are typically not implemented in the subsystem PLC controllers due to complexity and high computing power demands, the coordinated control device 104 may provide the adequate computing environment for implementing these controllers.

In some embodiments, control of the various systems of the drilling rig 102 may be provided via a multi-tier (e.g., three-tier) control system that includes a first tier of the controllers 126, 132, and 138, a second tier of the coordinated control device 104, and a third tier of the supervisory control system 107. The first tier of the controllers may be responsible for safety critical control operation, or fast loop feedback control. The second tier of the controllers may be responsible for coordinated controls of multiple equipment or subsystems, and/or responsible for complex model based controllers. The third tier of the controllers may be responsible for high level task planning, such as to command the rig system to maintain certain bottom hole pressure. In other embodiments, coordinated control may be provided by one or more controllers of one or more of the drilling rig systems 110, 112, and 114 without the use of a coordinated control device 104. In such embodiments, the rig computing resource environment 105 may provide control processes directly to these controllers for coordinated control. For example, in some embodiments, the controllers 126 and the controllers 132 may be used for coordinated control of multiple systems of the drilling rig 102.

The sensor data 140, 142, and 144 may be received by the coordinated control device 104 and used for control of the drilling rig 102 and the drilling rig systems 110, 112, and 114. In some embodiments, the sensor data 140, 142, and 144 may be encrypted to produce encrypted sensor data 146. For example, in some embodiments, the rig computing resource environment 105 may encrypt sensor data from different types of sensors and systems to produce a set of encrypted sensor data 146. Thus, the encrypted sensor data 146 may not be viewable by unauthorized user devices (either offsite or onsite user device) if such devices gain access to one or more networks of the drilling rig 102. The sensor data 140, 142, 144 may include a timestamp and an aligned drilling parameter (e.g., depth) as discussed above. The encrypted sensor data 146 may be sent to the remote computing resource environment 106 via the network 108 and stored as encrypted sensor data 148.

The rig computing resource environment 105 may provide the encrypted sensor data 148 available for viewing and processing offsite, such as via offsite user devices 120. Access to the encrypted sensor data 148 may be restricted via access control implemented in the rig computing resource environment 105. In some embodiments, the encrypted sensor data 148 may be provided in real-time to offsite user devices 120 such that offsite personnel may view real-time status of the drilling rig 102 and provide feedback based on the real-time sensor data. For example, different portions of the encrypted sensor data 146 may be sent to offsite user devices 120. In some embodiments, encrypted sensor data may be decrypted by the rig computing resource environment 105 before transmission or decrypted on an offsite user device after encrypted sensor data is received.

The offsite user device 120 may include a client (e.g., a thin client) configured to display data received from the rig computing resource environment 105 and/or the remote computing resource environment 106. For example, multiple types of thin clients (e.g., devices with display capability and minimal processing capability) may be used for certain functions or for viewing various sensor data.

The rig computing resource environment 105 may include various computing resources used for monitoring and controlling operations such as one or more computers having a processor and a memory. For example, the coordinated control device 104 may include a computer having a processor and memory for processing sensor data, storing sensor data, and issuing control commands responsive to sensor data. As noted above, the coordinated control device 104 may control various operations of the various systems of the drilling rig 102 via analysis of sensor data from one or more drilling rig systems (e.g. 110, 112, 114) to enable coordinated control between each system of the drilling rig 102. The coordinated control device 104 may execute control commands 150 for control of the various systems of the drilling rig 102 (e.g., drilling rig systems 110, 112, 114). The coordinated control device 104 may send control data determined by the execution of the control commands 150 to one or more systems of the drilling rig 102. For example, control data 152 may be sent to the downhole system 110, control data 154 may be sent to the fluid system 112, and control data 154 may be sent to the central system 114. The control data may include, for example, operator commands (e.g., turn on or off a pump, switch on or off a valve, update a physical property setpoint, etc.). In some embodiments, the coordinated control device 104 may include a fast control loop that directly obtains sensor data 140, 142, and 144 and executes, for example, a control algorithm. In some embodiments, the coordinated control device 104 may include a slow control loop that obtains data via the rig computing resource environment 105 to generate control commands.

In some embodiments, the coordinated control device 104 may intermediate between the supervisory control system 107 and the controllers 126, 132, and 138 of the systems 110, 112, and 114. For example, in such embodiments, a supervisory control system 107 may be used to control systems of the drilling rig 102. The supervisory control system 107 may include, for example, devices for entering control commands to perform operations of systems of the drilling rig 102. In some embodiments, the coordinated control device 104 may receive commands from the supervisory control system 107, process the commands according to a rule (e.g., an algorithm based upon the laws of physics for drilling operations), and/or control processes received from the rig computing resource environment 105, and provides control data to one or more systems of the drilling rig 102. In some embodiments, the supervisory control system 107 may be provided by and/or controlled by a third party. In such embodiments, the coordinated control device 104 may coordinate control between discrete supervisory control systems and the systems 110, 112, and 114 while using control commands that may be optimized from the sensor data received from the systems 110 112, and 114 and analyzed via the rig computing resource environment 105.

The rig computing resource environment 105 may include a monitoring process 141 that may use sensor data to determine information about the drilling rig 102. For example, in some embodiments the monitoring process 141 may determine a drilling state, equipment health, system health, a maintenance schedule, or any combination thereof. Furthermore, the monitoring process 141 may monitor sensor data and determine the quality of one or a plurality of sensor data. In some embodiments, the rig computing resource environment 105 may include control processes 143 that may use the sensor data 146 to optimize drilling operations, such as, for example, the control of drilling equipment to improve drilling efficiency, equipment reliability, and the like. For example, in some embodiments the acquired sensor data may be used to derive a noise cancellation scheme to improve electromagnetic and mud pulse telemetry signal processing. The control processes 143 may be implemented via, for example, a control algorithm, a computer program, firmware, or other suitable hardware and/or software. In some embodiments, the remote computing resource environment 106 may include a control process 145 that may be provided to the rig computing resource environment 105.

The rig computing resource environment 105 may include various computing resources, such as, for example, a single computer or multiple computers. In some embodiments, the rig computing resource environment 105 may include a virtual computer system and a virtual database or other virtual structure for collected data. The virtual computer system and virtual database may include one or more resource interfaces (e.g., web interfaces) that enable the submission of application programming interface (API) calls to the various resources through a request. In addition, each of the resources may include one or more resource interfaces that enable the resources to access each other (e.g., to enable a virtual computer system of the computing resource environment to store data in or retrieve data from the database or other structure for collected data).

The virtual computer system may include a collection of computing resources configured to instantiate virtual machine instances. The virtual computing system and/or computers may provide a human-machine interface through which a user may interface with the virtual computer system via the offsite user device or, in some embodiments, the onsite user device. In some embodiments, other computer systems or computer system services may be utilized in the rig computing resource environment 105, such as a computer system or computer system service that provisions computing resources on dedicated or shared computers/servers and/or other physical devices. In some embodiments, the rig computing resource environment 105 may include a single server (in a discrete hardware component or as a virtual server) or multiple servers (e.g., web servers, application servers, or other servers). The servers may be, for example, computers arranged in any physical and/or virtual configuration In some embodiments, the rig computing resource environment 105 may include a database that may be a collection of computing resources that run one or more data collections. Such data collections may be operated and managed by utilizing API calls. The data collections, such as sensor data, may be made available to other resources in the rig computing resource environment or to user devices (e.g., onsite user device 118 and/or offsite user device 120) accessing the rig computing resource environment 105. In some embodiments, the remote computing resource environment 106 may include similar computing resources to those described above, such as a single computer or multiple computers (in discrete hardware components or virtual computer systems).

Figure 3:
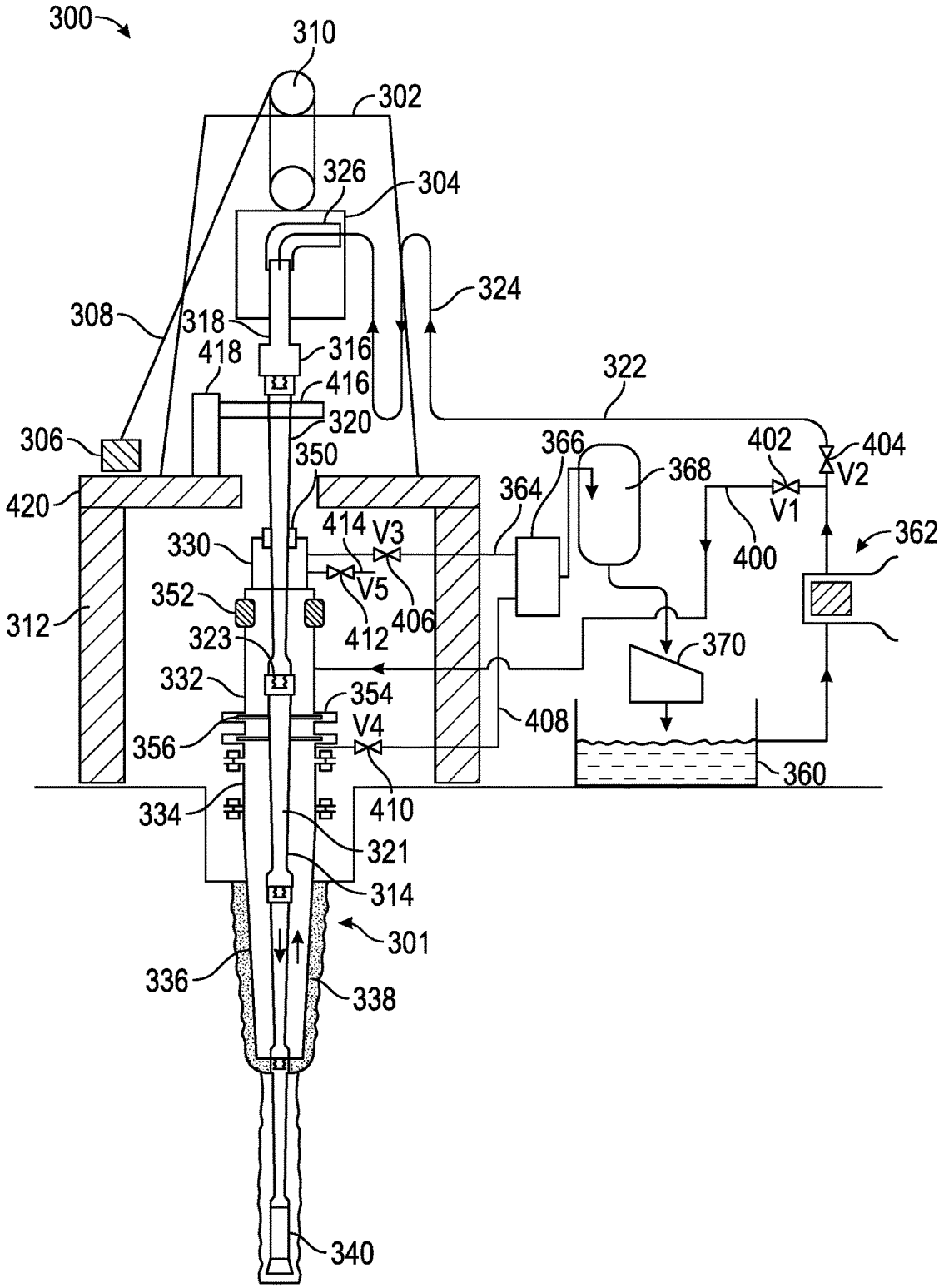
FIG. 3 illustrates a schematic view of a drilling system, according to an embodiment.

FIG. 3 illustrates a conceptual, schematic view of a drilling system 300, according to an embodiment. The drilling system 300 may be located partially above and partially within a wellbore 301, as shown, e.g., after drilling operations have commenced. The drilling system 300 may include a mast 302 from which a top drive 304 (or another tubular-rotating and/or tubular-supporting, drilling device) is movably supported. For example, the top drive 304 may be raised and lowered along the mast 302 using a drawworks 306 coupled to the top drive 304 via a drilling line 308 received through a set of sheaves 310.

The drilling system 300 may also include a rig substructure 312 that may support the mast 302 and the structures coupled therewith. The rig substructure 312 may straddle the wellbore 301. A drill string 314 may be received through an opening in the rig substructure 312 and may extend into the wellbore 301. The drill string 314 may be supported by the top drive 304, e.g., via a connection with a shaft 316 (or "quill") that is rotated by the top drive 304. The shaft 316 may define a neck 318, which may be connected to the box-end connection of the upper-most tubular 320 of the drill string 314. The upper-most tubular 320 may connect with a next tubular 321 at a connection 323. The tubular 320 may be representative of a quill extension (e.g., a pipe that extends from the quill shaft 316), an upper-most stand of one or more tubulars to be joined to the drill string 314, or any other suitable structure. A mud supply line 322, which may include a standpipe 324, may be coupled to an interior of the shaft 316 via a conduit 326 within the top drive 304. The top drive 304 may rotate the shaft 316, and a rotary seal (not shown) between the conduit 326 and the shaft 316 may retain the pumped fluid inside the bore of the conduit 326 and shaft 316.

The drill string 314 may also be received through a rotating control device ("RCD") 330, a blowout preventer ("BOP") 332, and a wellhead 334. The RCD 330 may be (e.g., releasably) coupled to the BOP 332 and positioned above the BOP 332, as shown, such that the BOP 332 is positioned between the RCD 330 and the wellhead 334. Below the wellhead 334, the drill string 314 may extend into the wellbore 301, which may be, as shown, partially cased with a casing 336 and/or cemented with a cement layer 338. The drill string 314 may extend to its distal terminus, where a bottom hole assembly ("BHA") 340, e.g., including a drill bit, may be located.

The RCD 330 may include an RCD seal 350, e.g., at or toward the top thereof, so as to provide a fluid-tight seal with the drill string 314. The BOP 332 may include an elastomeric annular body or seal, which may be referred to as a BOP annular preventer or, more succinctly, a BOP annular 352. The BOP annular 352 may be selectively opened and closed, such that a seal is formed with the drill string 314 when the BOP annular 352 is closed.

The BOP 332 may also include a "many-cycle" pipe ram assembly 354 and a tubular lock 356, which may both be positioned below the BOP annular 352, i.e., within the BOP 332. The relative position of the pipe ram assembly 354 and tubular lock 356 may be as shown, with the pipe ram assembly 354 vertically above the tubular lock 356, or may be reversed. The pipe ram assembly 354 may be configured to seal the annulus between the BOP 332 and the drill string 314, and the tubular lock may be configured to prevent the drill string 314 from rotating, when engaged. Further, either or both of the pipe ram assembly 354 and the tubular lock 356 may be employed to support the weight of the drill string 314 within the wellbore 301. Moreover, the BOP 332 may be coupled to or otherwise positioned above (e.g., directly above) the wellhead 334. Additional details for an embodiment of the pipe ram assembly 354 are described below.

During drilling operations, a fluid or slurry "drilling mud" is provided into the wellbore 301 through the drill string 314, e.g., to remove cuttings, maintain bottom hole pressure, reduce friction, etc. The mud may be provided from a pit (or tank) 360, and may be pumped through the mud supply line 322 via a pump 362. The pump 362 may be referred to as a mud triplex, as it may be provided by a three-piston pump; however, any suitable type of pump may be employed. In the illustrated embodiment, the mud pumped through the mud supply line 322 is delivered through the conduit 326 of the top drive 304, the shaft 316, the drill string 314, and the BHA 340, to the distal end of the wellbore 301. The mud then circulates back up through the wellbore 301, through the wellhead 334, the BOP 332, and the RCD 330.

The drilling system 300 may include a flow line 364, which may receive the mud from the RCD 330, and deliver the mud to a choke 366, which may be employed, e.g., to manage pressure during drilling (e.g., as part of a managed pressure drilling (MPD) operation). From the choke 366, the mud may be delivered to a mud-gas separator ("MGS") 368, which may remove gases therefrom. From the MGS 368, the mud may be delivered to a shale shaker 370, which removes particulates therefrom, and finally may be delivered back to the mud pit 360. This may be the primary flowpath for the drilling mud, e.g., through the top drive 304 and the drill string 314, into the wellbore 301, and out through the BOP 332 and the RCD 330. The flow of drilling mud through this flowpath may be referred to as a "first" flow of the drilling mud.

The drilling system 300 may also provide a secondary flowpath through which a second flow of fluid may proceed. For example, in the illustrated embodiment, the drilling system 300 includes a second or "alternate" mud supply line 400, which may extend from the mud supply line 322 to the BOP 332, below the BOP annular 352. A first valve (V1) 402 may be disposed in the alternate mud supply line 400. When open, the first valve 402 may divert mud from the mud supply line 322, and deliver it directly to the BOP 332. Moreover, the mud supply line 322 may include a second valve (V2) 404, which may, for example, be closed to block mud flow to the top drive 304 via the mud supply line 322. Similarly, the flow line 364 may include a third valve (V3) 406 configured to open and close, allowing and blocking, respectively, mud flow from the RCD 330 to the choke 366.

The drilling system 300 may also include a second or "alternate" flow line 408, which may extend from the BOP 332 to the choke 366. For example, the alternate flow line 408 may extend from a position below the pipe ram assembly 354. The alternate flow line 408 may also include a fourth valve (V4) 410, which may open and close to allow and prevent, respectively, a mud flow from the BOP 332 directly to the choke 366. The drilling system 300 may further include a bleed line 414, which may include a fifth valve (V5) 412 that is similarly operable with respect to the bleed line 414, and may be employed to relieve pressure in the RCD 330 when the BOP annular 352 is closed. In various embodiments, the bleed line 414 may be connected to the choke 366, the MGS 368, or the mud pit 360. The second flow of drilling mud may thus employ these alternate lines 400, 408, and may be delivered to and received directly from the BOP 332.

The drilling system 300 may further include an RCD seal locator 416 and an actuator 418 positioned at or above a rig floor 420 of the rig substructure 312. The RCD seal locator 416 may be configured to move with and/or apply a moving force, e.g., via the actuator 418, to the RCD 330 or a part thereof. Accordingly, the RCD seal locator 416 may be configured to maintain the RCD seal 350 at a chosen position above the rig floor 420 while the RCD seal 350 is still on the shaft 316.

Figure 4A:
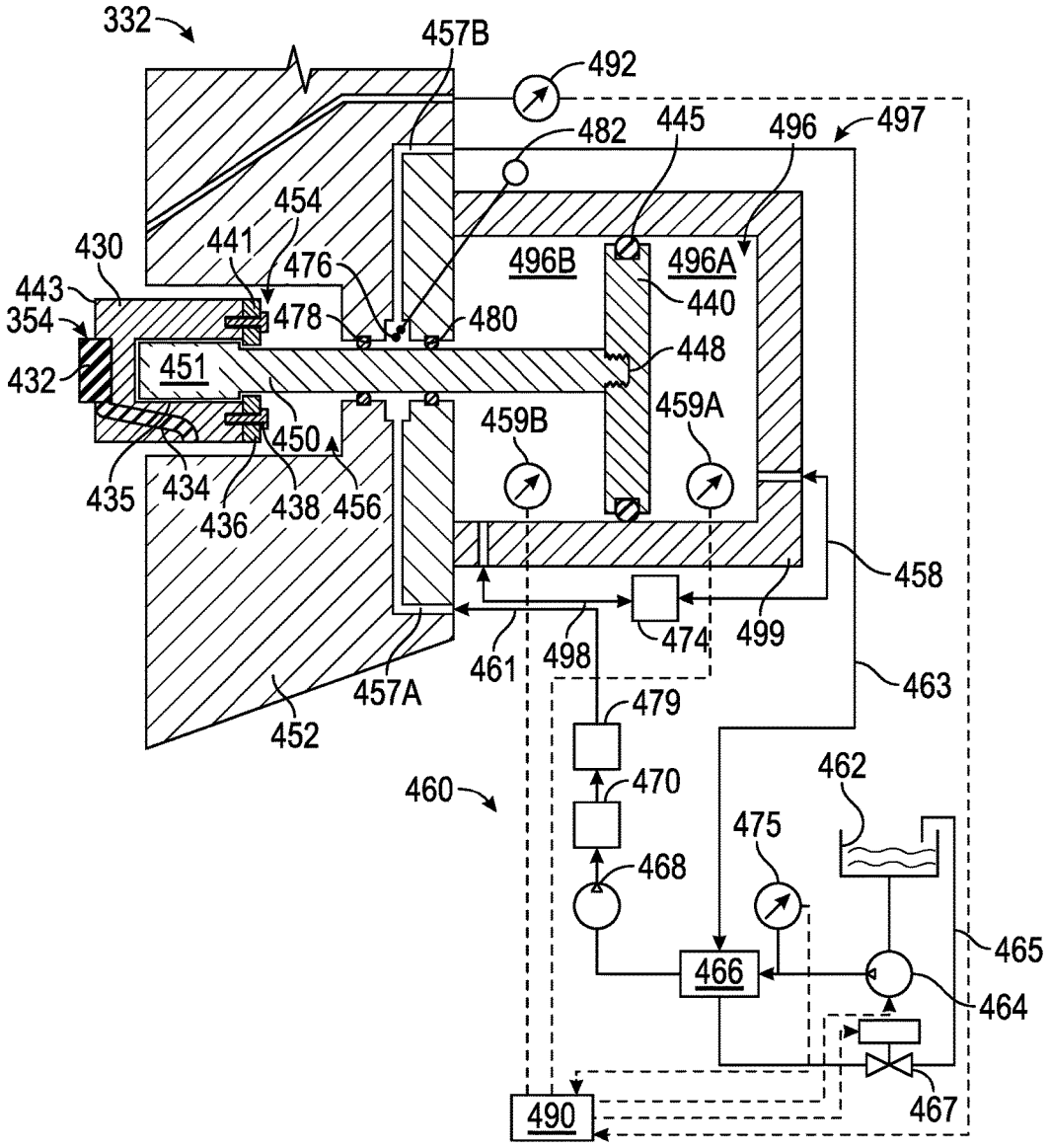
FIG. 4A illustrates a schematic view of a pipe ram, according to an embodiment.

FIG. 4A illustrates a schematic view of the pipe ram assembly 354 inside the BOP 332, according to an embodiment. The pipe ram assembly 354 includes a ram 430, which may be positioned within a body 452 of the BOP 332. In particular, the ram 430 may be positioned within a first recess 454 formed in the body 452. The ram 430 may include a proximal end 441 and a distal end 443. The distal end 443 may be configured to engage the drill string 314 (FIG. 3), e.g., to at least partially seal therewith and transmit a weight thereof to the body 452. In an embodiment, the ram 430 may be movable with respect to the body 452, e.g., into and partially out of the first recess 454, such that the ram 430 may be configured to engage and support the drill string 314 (FIG. 3) when in an extended position, and release from the drill string 314 when in a retracted position.

A first or "main" chamber 456 may be defined in the first recess 454, between the proximal end 441 of the ram 430 and the body 452. The main chamber 456 may increase in volume when the ram 430 moves from the retracted position to the extended position. The main chamber 456 may be filled with well fluid from the high pressure side, past the ram 430, after the closing. The high pressure side may be above or below the ram 430.

A first sealing element 432 may be positioned at the proximal end 443 of the ram 430. The first sealing element 432, which may be, for example, an elastomer, may be configured to seal against the drill pipe 314 (FIG. 3), as well as against an opposite ram (not viewable), such that the two rams 430 and the drill pipe 314 form a fluid-tight seal. A second sealing element 434 seals against the recess 454 of the BOP body 452, and may meet with the first sealing element 432, such that a sealing interface is continuous with respect to the two sealing elements 432, 434. The space between the BOP body 452 and the ram 430, defining the recess 454, is exaggerated for ease of viewing in FIG. 4A, as the second sealing element 434 is sized and positioned to seal with the BOP body 452.

The ram 430 may define a bore 435 extending partially therein, from the proximal end 441 thereof. The pipe ram assembly 354 may thus further include a rod 450 (e.g., a polished rod), which may be received at least partially within the bore 435. In a specific embodiment, the rod 450 may have a bulge 451 at one end, which may be received into the bore 435, as shown. This bulge 451 may be retained in the bore 435 by a lock plate 436 held on the ram 430 by lock screws 438. Various other devices and structures for securing the rod 450 to the ram 430 may be employed, with the illustrated assembly being just one among many contemplated. In this embodiment, the bore 435 may be larger than the bulge 451, which may allow for a degree of vertical (as shown in the figure) movement between the ram 430 and the rod 450. This may facilitate moving the ram 430 with respect to the BOP body 452 and sealing the ram 430 therewith, as will be explained in greater detail below.

The pipe ram assembly 354 may also include an actuation assembly 497. The actuation assembly 497 may include a housing (e.g., a cylinder) 499, in which an actuation chamber 496 may be defined. A piston 440 may be slidably positioned in the housing 499, and may include one or more seals 445 that form a fluid-tight interface between the piston 440 and the housing 499. Accordingly, the piston 440 may effectively partition the actuation chamber 496 into first and second sides 496A, 496B. The piston 440 may be connected to the rod 450 at 448, and thereby to the ram 430, such that movement of the piston 440 results in movement of the rod 450 into or out of the recess 454.

In order to move the piston 440, pressure may be selectively introduced to or removed from the actuation chamber 496 via a first fluid line 458, on the first side 496A, and via the second fluid line 498 on the second side 496B. In an embodiment, a pressurized oil may be employed to transmit such pressure, but in other embodiments, other types of fluids may be used. A pressure gauge 459A may be employed to measure the pressure in the first side 496A of the actuation chamber 496, and a pressure gauge 459B may be employed to measure the pressure in the second side 496B of the actuation chamber 496. In other embodiments, the pressures in the lines 458, 498 may be measured to similar effect. A BOP pressure gauge 492 may be employed to measure the pressure inside the BOP 332.

From the measurements of the pressures acting on the first and second sides 496A, 496B of the piston 440, and a priori knowledge of the static piston 440 geometry, the actuating force on the rod 450 may be determined. This force can be in either direction so the ram 354 may be forced towards the closing position or to the open position by the actuation assembly. The net closing force may then be determined as the difference between the actuation force and the force generated by pressure of the fluid in the wellbore acting on the sealing section defined by the seal 478.

The pipe ram assembly 354 may also include a buffer system 460, which may mitigate or prevent fluids from migrating between the BOP 332 and into the actuation chamber 496 along the rod 450. The buffer system 460 may include a second supply line 461 that is in communication with an inlet passage 457A defined in the body 452. The second supply line 461 may be configured to transport, via the inlet passage 457A, a fluid into an annular recess 476 defined in the body 452, through which the rod 450 extends. The recess 476 may be located between two seals 478 and 480, which seal with the rod 450. The buffer system 460 may also include a return line 463, and the BOP body 452 may define an outlet passage 457B in communication with the return line 463. The return line 463 may be configured to receive, via the outlet passage 457B, fluid from the recess 476. Further, the buffer system 460 may also include a fluid reservoir 462, a first pump 464, a buffer vessel 466, a second pump 468, a filter 470, a discharge valve 467, a discharge line 465, and a sensor 475, which may be in fluid communication with one another via the supply line 461.

The reservoir 462 may store a buffer fluid, such as oil, generally in an unpressurized state, e.g., at ambient pressure. In other embodiments, the reservoir 462 may provide a pressurized containment for the buffer fluid, as compared to ambient (e.g., atmospheric) pressure. The first pump 464 may receive the unpressurized buffer fluid from the reservoir 462, via the supply line 461, and provide a pressurized (as compared to ambient) buffer fluid to the buffer vessel 466. The buffer vessel 466 may provide for storage of the pressurized buffer fluid. Further, the buffer system 460 may include a buffer pressure gauge 475 in the supply line 461 between the first pump 464 and the buffer vessel 466, from which the pressure of fluid in the buffer vessel 466 may be inferred. In other embodiments, the buffer pressure gauge 475 may be positioned elsewhere, e.g., downstream from the buffer vessel 466. A controller 490 may monitor the buffer pressure gauge 475 and control the pressure in the buffer vessel 466 by controlling the pump 464 or modulating the valve 467.

The second pump 468 may receive the pressurized fluid and circulate it through the filter 470, for cleaning, and thereafter, through a sensing system 479. The sensing element 479 may be configured to detect the density, pressure, temperature, composition (e.g., presence of contaminants, etc.), viscosity, etc. of the pressurized buffer fluid. The supply line 461 may direct buffer fluid from the sensor 472 to the annular recess 476. Further, the supply line 461 may be positioned on a first side of the annular recess 476, and the return line 463 may be positioned on a second side of the annular recess 476, so as to promote circulation of the buffer fluid throughout the annular recess 476 and between the seals 478, 480.

As schematically depicted, a pressure gauge 482 may be employed to monitor a pressure of the fluid in the annular recess 476. 3. The pressure of the buffer fluid within the annular recess 476 may be determined based on the pressure measured by the buffer pressure gauge 475, or by another pressure gauge, e.g., within the annular recess 476.

The buffer fluid may exit from the annular recess 476 via the return line 463, which may extend from the annular recess 476, e.g., at least partially through the body 452 of the BOP 332, and to the buffer vessel 466 and/or the reservoir 462, for pressurization, filtration, cooling, and/or any other suitable processing before re-entry into the annular recess 476.

The controller 490 may be a stand-alone processor, or may be provided as a part of the functionality of the rig control system 100, discussed above. The controller 490 may communicate with the 459A, 459B, 475, and/or 492 and the first pump 464. The controller 490 may be configured to maintain the pressure of the fluid in the annular recess 476 equalized with (or slightly higher than) with the pressure in the fluid contained in the BOP 332, as measured by the BOP pressure gauge 492. In such condition, some fluid from the buffer vessel 466 may leak inside across the seal 478 and into the recess 454. The controller 490 may effect such equalization by comparing the pressure measurements taken by the BOP pressure gauges 492, 459B and the buffer pressure gauge 475, and adjusting the pressure of the buffer fluid in the supply line 461 by changing the operation of the first pump 464, bleeding pressure from the buffer vessel 466 via the valve 467, or a combination thereof. As such, a low, or no, pressure differential may be maintained across the seal 478 between the annular recess 476 and the recess 454, which may restrict or prevent migration of fluids from the inside the BOP 332 into the annular recess 476, thereby protecting the buffer fluid from contamination.

In some situations, the drilling fluids, formation fluids, etc., in the wellbore, may migrate past the seal 478 and into the annular recess 476 in which the buffer fluid is circulated. Accordingly, the fluid in the annular recess 476 is circulated via the pump 468 through the annular recess 476 through the filter 470. The filter 470 may be configured to remove such contaminants from the buffer fluid. By maintaining clean buffer fluid, the seal 478 may remain lubricated and may be used in multiple opening/closing operations, while minimizing wear. Further, maintaining a low pressure differential across the seal 478 may also reduce wear in the seal 478, as oil from the reservoir 466 may leak through the seal 478, avoiding particles from the mud inside the BOP 332 damaging the seal 478.

In an embodiment, the fluid acting against the actuating piston 440 may be different than the buffer fluid of the buffer system 460. For example, the fluids may be stored in different reservoirs. As shown, the buffer fluid may be stored in the reservoir 462 and the actuation fluid may be stored in a separate reservoir 474. In some embodiments, the actuating fluid and the buffer fluid may be the same type of fluid or oil, whether or not they are segregated as described above.

Further, the buffer fluid in annular recess 476 is isolated from the actuating fluid in the actuating chamber 496 by the seal 480. The buffer fluid may be at pressure, as explained above, to minimize the pressure differential across the seal 478 to prevent contamination of the buffer fluid by the wellbore fluids. As a consequence, a pressure differential may develop across the seal 480, as the actuating fluid in the second side 496B of the actuating chamber 496 may be at low (e.g., ambient) pressure. However, fluid migration across the seal 480 may be of less concern, because, as noted, the fluids may be compatible and, further, both fluids may be substantially free from contamination. Moreover, in some embodiments, the actuating fluid may also be passed through a filter during actuation process, so that any pollutants transmitted from the buffer system 460 may be removed.

Figure 4B:
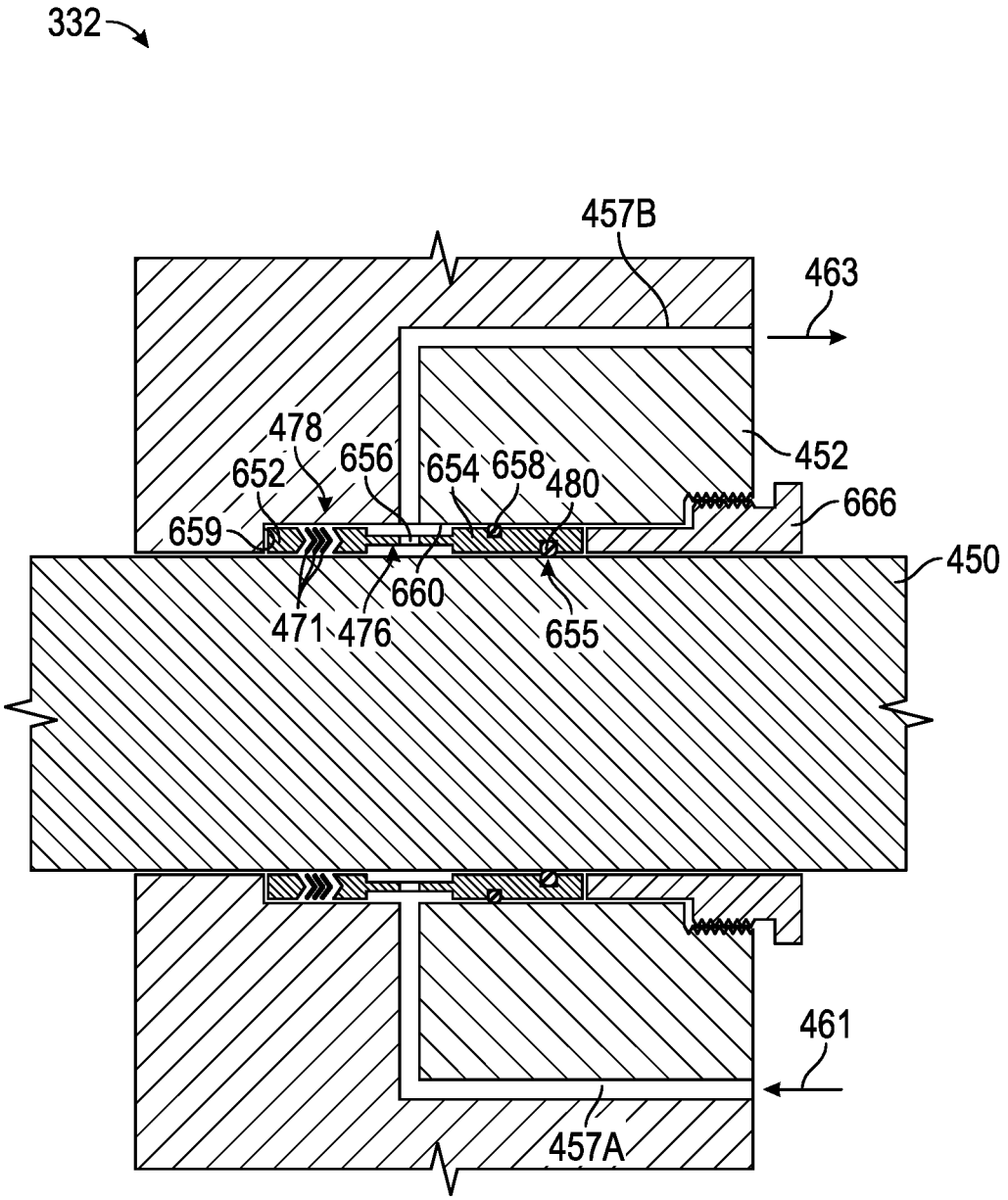
FIG. 4B illustrates a side, cross-sectional view of a seal assembly for a rod of the pipe ram, according to an embodiment.

FIG. 4B illustrates a side, cross-sectional view of a sealing assembly for creating the seal between the rod 450 and the BOP body 452 on either side of the annular recess 476, according to an embodiment. As noted above, the seals 478 and 480 perform this function; FIG. 4B illustrates an example of the sealing assembly that includes these seals 478, 480 in greater detail.

In an embodiment, the seal 478 may be a stack of V-packing sealing elements 471. The V-packing elements 471 are supported on one side by a shaped ring 652 that may abut a shoulder 659 of the BOP body 452.and on the other side by support body 654. The support body 654 also includes a circumferential groove 655 for the seal 480 acting against the rod 450. An additional static seal 658 may also be provided and may seal against a bore 660 inside the BOP body 452, through which the rod 450 extends, and against the support body 654.

The annular recess 476 may be defined by the support body 654. The inlet passage 457A allows fluid supply into the annular recess 476 from the supply line 461. The outlet passage 457B allows the fluid exit from the annular recess 476 into the line 463. Holes 656 through the support body 654 allow the passage of fluid therethrough into and out of the annular recess 476.

A retainer 666 may be received into the bore 660, and may be threaded thereto. The retainer 666 may engage or be positioned axially adjacent to the support body 654. In an embodiment, the retainer 666 may be screwed further into or out of the bore 660 so as to increase or decrease compression on the seal 478 between the support body 654 and the ring 652, so as to allow for adjustments to the compression thereof.

Figure 4C:
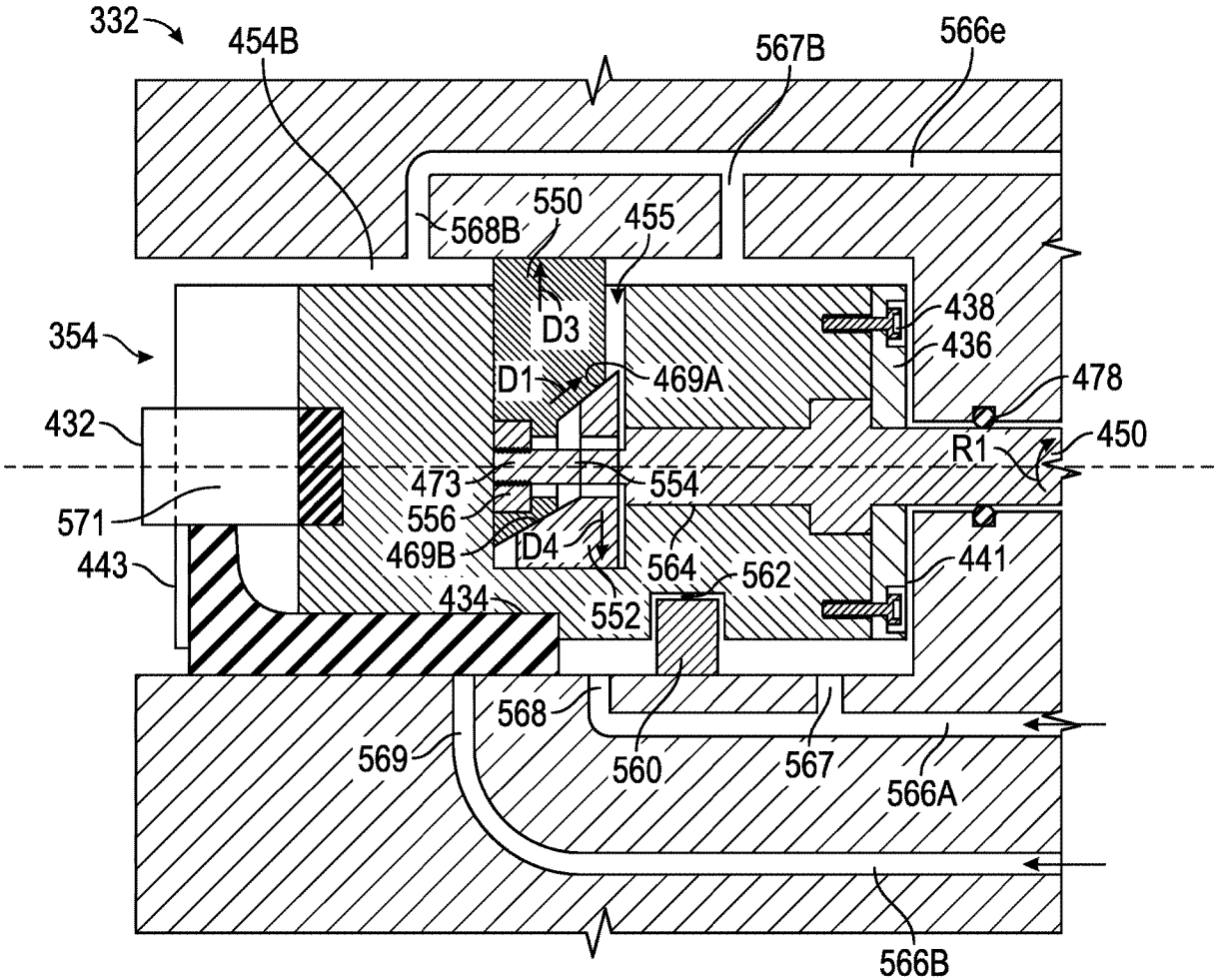
FIG. 4C illustrates a more detailed, side, cross-sectional view of the pipe ram assembly, according to an embodiment.

FIG. 4C illustrates cross-sectional view of the ram 430 of the pipe ram assembly 354, depicting the ram 430 in greater detail, according to an embodiment. When the pipe rams 430 are in the closed position, the pressure may be higher above the rams 430 than below. As such, the ram 430 may be pressed downwards, thereby compressing the second sealing element 434 against the recess 454 in the BOP body 452. It will be readily appreciated that the ram 430 may be flipped for applications in which the pressure below the ram 430 is expected to be greater than above.

The ram 430 may include a lift-piston 560, which is pushed out (downwards) of the ram 430 by a biasing member 562 such as a spring. Prior to the ram 430 closing against the drill pipe and sealing the wellbore, the force applied by the biasing member 562 may hold the ram 430 away from the wall of the recess 454. As such, the second sealing element 434 may slightly engage but may avoid being compressed against the recess 454, which may facilitate moving the ram 430 with respect to the BOP body 452 while avoiding or mitigating wear on the second sealing element 434.

Pressure equilibrium above and below the ram 430 during closing thereof may be maintained using BOP valves, such as the first and fourth valves 410 and V1 402 (e.g., FIG. 3). The rod 450 moves the ram 430 under the activation provided by pressure applied on the piston 440 (e.g., FIG. 4A).

When the pipe ram 430 is closed, the ram seal activation system may be activated. This system may include an activation block 550 and a reaction block 552 disposed in a ram radial slot 455. The blocks 550, 552 may receive therethrough an extension 554 of the rod 450. Further, the openings through the blocks 550, 552 in which the extension 554 is received may be larger than the extension 554, so as to allow for vertical displacement of the blocks 550, 552 relative to the rod 450. Further, the vertical movement in a direction D3 of the activation block 550 and vertical movement in a direction D4 of the reaction block 552 is obtained by the relative displacement of the blocks 550, 552 in the direction D1 over the inclined surfaces 469A, 469B between the activation and reaction blocks 550, 552.

This sliding is obtained by axially pressing the activation block 550 and the reaction block 552 due to the screwing effect of a square nut 556 onto a thread 473 of the extension 554 of the rod 450. The screwing effect is obtained by rotating the rod 450 in direction R1. The vertical movement of activation block 550 may cause the activation block 550 to contact the BOP body 452 in the recess 454. The reaction block 552 may be pushed in the other direction (downwards) forcing the ram 430 to be pushed against the BOP body 452 on the side of the second sealing element 434. This movement may increase compression of the second sealing element 434, while reducing the extrusion gap for this second sealing element 434 between the ram 430 and the BOP body 452. The openings through the activation block 550 and the reaction block 552 may be sized to allow the blocks to be displaced relative to the extension 554.

The seal activation system may be de-activated for withdrawing the ram 430 from the closed position, e.g., out of engagement with the drill pipe. To do so, the rod 450 may be rotated in a direction opposite to the rotation R1. This may unscrew the nut 556 from the extension 554, allowing the activation block 550 to slide down the inclined surface 469A and decreasing the force applied by the reaction block 552 on the ram 430. The biasing force applied by the biasing member 562 may then once again apply an upwards force on the ram 430 that may reduce or avoid compression of the second sealing element 434

Further, injection ports 567A, 567B, 568A, 568B may be provided to allow for the injection of fluid (e.g., a clean mud) mud via a port 566A in the BOP body 452. Such fluid may be pumped at a pressure slightly higher than the pressure inside the BOP 332. Thus, the injected fluid may serve to flush cuttings or other particulates away from the recess 454 between the ram 430 and the BOP body 542. Additionally, a port 569 allows the injection of a fluid (e.g., clean mud) on the other side of the second sealing element 434. This fluid may be provided into the recess 454 via a port 566B in the BOP body 452. The mud injected in passages 566A, 566B may be isolated from each other as the pressure may be different between these two passages after closing the ram 430. The second sealing element 434 may serve as the pressure barrier therebetween after ram 430 closes. In one embodiment, one or more pumps, e.g., two independent pumps (e.g., small piston pump or small triplex pumps), may be used to feed the fluid into the recess 454 via the passages 566A, 566B. The ram 430 defines therein a cylindrical recess 571 shaped to accommodate the drill pipe after closure.

Figure 4D:
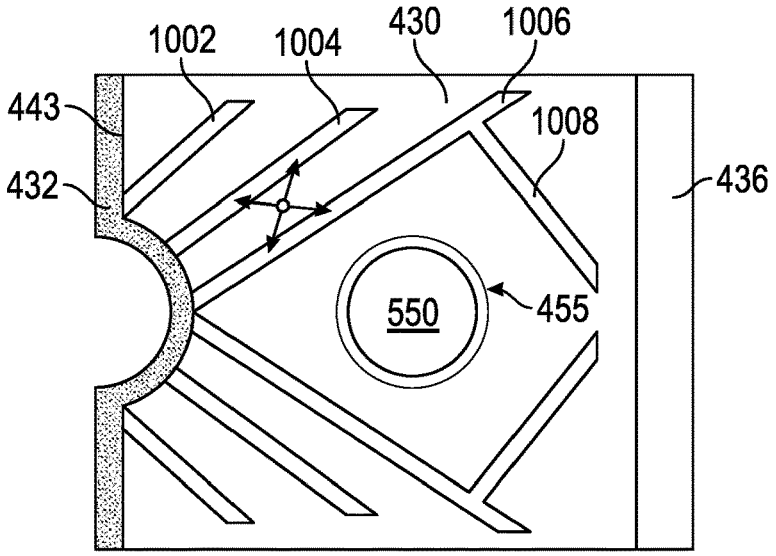
FIG. 4D illustrates a high-pressure side of the pipe ram, according to an embodiment.

FIG. 4D illustrates a plan view of the ram 430, according to an embodiment. In particular, this view shows the side of ram 354 facing the "high pressure" in the BOP 332 after closing the pipe ram assembly 354. Grooves 1002, 1004, 1006, 1008 may collect the particles that may enter in the clearance between the ram 354 on the cavity in the BOP body 454. The clean mud injected from one port into the clearance flows at indicted by the arrows between the grooves 1004, 1006. This mud limits the intrusion of well mud into the clearance, so that the clearance stays clean. Also this injected mud entrains the particles potentially in the gap towards the grooves (1002 to 1008) and transport the particles into the BOP as indicted by the arrow FG (flow in Groove).

FIG. 4D illustrates a plan view of a high-pressure side of the ram 430, according to an embodiment. As shown in FIGS. 4A-4C, the high-pressure side is the top side. The ram 430 may define grooves 1002, 1004, 1006, 1008 therein, which may collect particles that may enter in the clearance between the ram 430 and the BOP body 452 in the recess 454. Further, the grooves 1002, 1004, 1006, 1008 may be positioned such that the fluid injected from the ports 567B, 568B into the recess 454 flows at indicted by the arrows, between and eventually into the grooves 1002, 1004, 1006, 1008. The fluid may then flow along the grooves 1002, 1004, 1006, 1008, e.g., toward the first sealing element 432. This fluid flushes wellbore fluids from the recess 454 between the ram 430 and the BOP body 452.

Figure 4E:
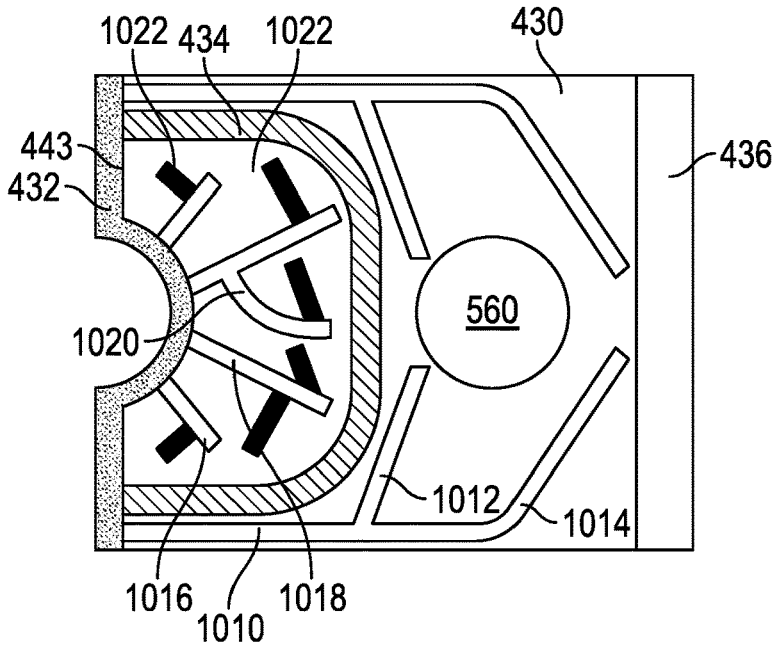
FIG. 4E illustrates a low-pressure side of the pipe ram, according to an embodiment.

Referring now to FIG. 4E, there is shown a plan view of the opposite side of the ram 430, e.g., the low-pressure side thereof, according to an embodiment. On this side, the ram 430 may also define grooves 1010, 1012, 1014, 1016, 1018, 1020, which may be positioned on either side of the second sealing element 434. For example, the grooves 1012, 1014 on the outside of the second sealing element 434 may provide a flowpath for flushing fluid, similar to that described above for the high-pressure side grooves. The grooves 1012, 1014 may intersect with and feed the fluid collected therein to the groove 1010, which may extend toward and channel the fluid toward the proximal end 443 of the ram 430 (where the first sealing element 432 is located). With such groove pattern, the fluid in the recess 454, between the ram 430 and the BOP body 452 may be provided at least in majority via the passage 566A.

Between the first and second sealing elements 432, 434, the grooves 1016, 1018, 1020 may channel fluid (e.g., drilling mud and entrained particles), again towards the first sealing element 432. The fluid received between the grooves 1016, 1018, 1020 and eventually therein to provide this flushing function may be provided by the port 569 (FIG. 4C).

Additionally, the ram 430 may include rubber scrappers 1022 that may be attached into small groves in the ram 430. These scrappers 1022 may facilitate removal of solids and particles in the recess 454 between the ram 430 and the BOP body 452, when the ram 430 moves form the open position to the closed position. The orientation of the scrappers 1022 may be configured to improve the sliding of the accumulated material towards the flow grooves 1016, 1018, 1020. Thus, the scrapers 1022 may assist in cleaning the clearance between the ram 430 and the BOP body 452 during the closing movement of the ram 430, thereby preventing solids from accumulating in front of the second sealing element 434.

FIG. 4E illustrates a schematic view of the pipe ram system 354, according to an embodiment. The ram 430 may be moved axially inside the BOP 332 via the movement of rod 450. This rod movement may be effected by adding or removing fluid on either side 496A, 496B of the actuation chamber 496, so as to force the piston 440 in one direction or the other.

Figure 4F:
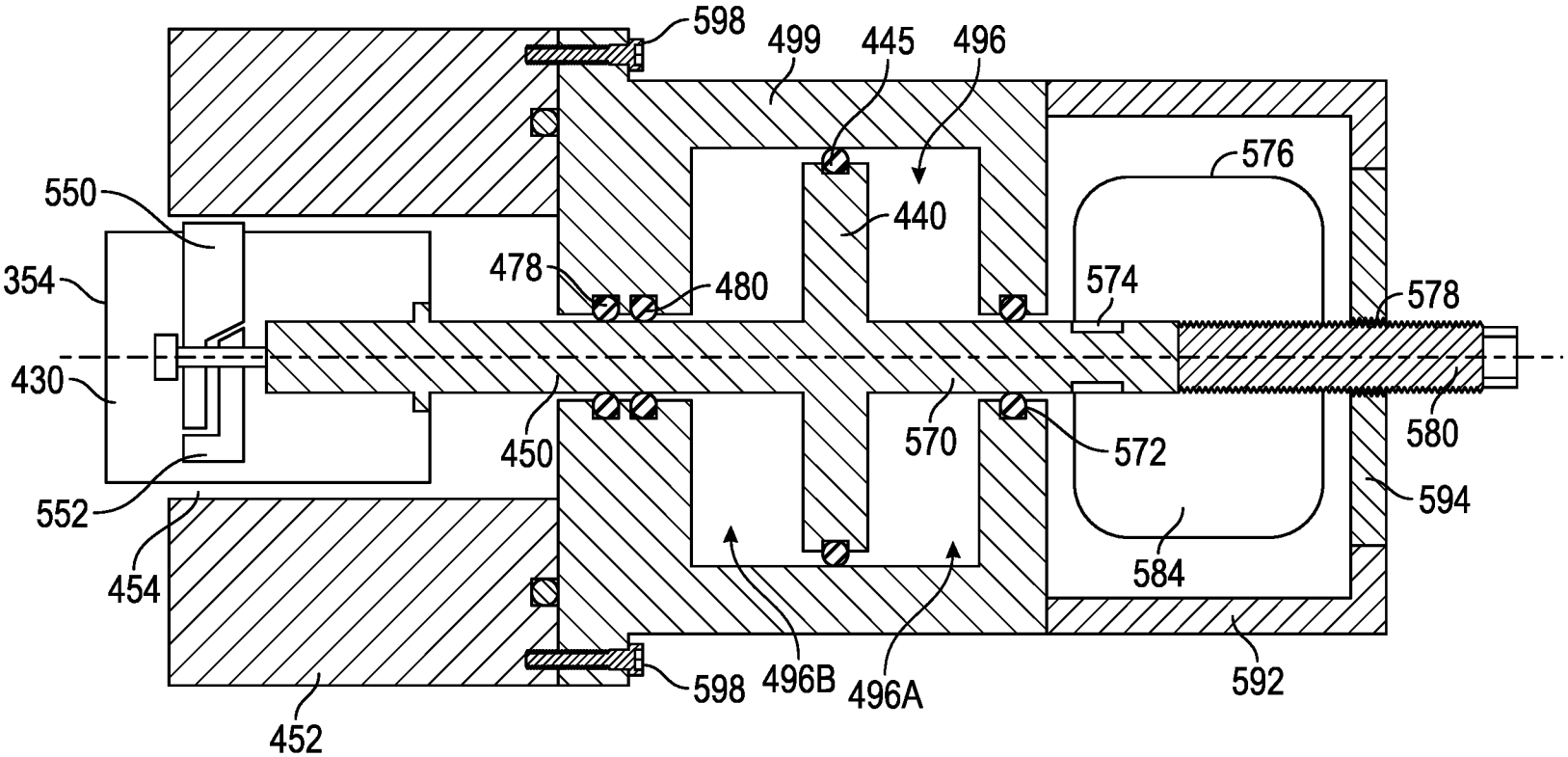
FIG. 4F illustrates a side, schematic view of the pipe ram in a locked position, according to an embodiment.

Referring to FIG. 4F, a cylindrical extension 570 is connected to the piston 440 and extends through the housing 499, outside of the actuation chamber 496, and into a second housing 592. The second housing 592 defines a second chamber 584 therein, which may be held generally at ambient pressure. A seal 572 may be placed at the intersection of the first and second housings 499, 592, which may seal with the extension 570 to contain the fluid within the actuation chamber 496.

In an embodiment, the atmospheric chamber 584 may be accessed by an opening 576. This allows to use a tool (e.g., a wrench) to engage and rotate a hexagonal section 574 of the extension 570. The wrench rotates the extension rod 570, the piston 440, the rod 450, thereby rotating the extension 554 (threaded extremity) relative to the nut 556 and generating changing the radial location of the ram 430 via displacement of the activation and reaction blocks 550, 552, as explained above with reference to FIG. 4C.

The housing 592 may further include a closing lid 594, through which a threaded hole 578 may be defined. A threaded lock rod 580 may be received through the hole 578, and may be sized to axially engage against the extension 570. When advanced, the threaded lock rod 580 may decrease the stroke of the piston 440. If advanced far enough, the threaded lock rod 580 may abut the extension 570 when the ram 430 is engaged with the drill pipe (e.g., in the closed position), thereby locking the ram 430 closed, and preventing its opening until the threaded rod 580 is rotated. In some embodiments, the threaded rod 580 rotated and threaded against the extension rod 570 to lock of the pipe ram 430. The hexagonal surface 574 allows for rotating the rod 450, e.g., using a wrench, and allowing the opening/retraction of the activation blocks 550, 552 via the rotation of the threaded extremity of the rod 550 in the square nut 556. For such rotation, the threaded lock rod 580 must not be abut against the extension 570.

Figure 5:
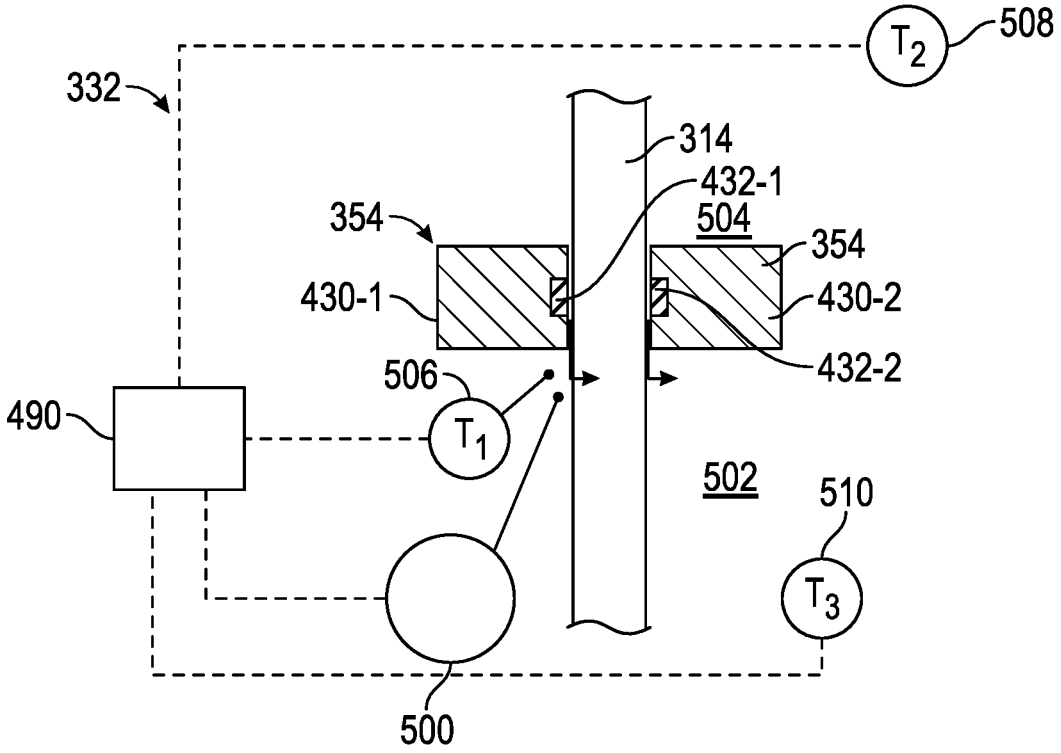
FIG. 5 illustrates a schematic view of the pipe ram with leakage sensors, according to an embodiment.

FIG. 5 illustrates a schematic view of the BOP 332, with the pipe ram assembly 354 in the closed position, according to an embodiment. In the closed position, the rams 430-1, 430-2 (more rams may also be present and may generally be constructed as the ram 430 discussed above) may engage the drill string 314, as shown. The ram 430 may be shaped, sized, and otherwise configured to form a fluid-tight seal with the drill string 314. The first sealing elements 432-1, 432-2, as well as the second sealing elements (not shown in FIG. 5) may be compressed between the ram 430 and the drill string 314 to form the seal. In some cases, the rams 430 may not form a fluid-tight seal with the drill string 314, resulting in leakage along the axis of the drill string 314 and BOP 332. The BOP 332 may be configured to detect such leakage.

For example, the BOP 332, as shown, may include sensors in the proximity of the pipe rams 430. Such sensors may be configured to detect leakage. In an embodiment, the BOP 332 may include an acoustic sensor 500, which may be positioned on the lower-pressure side of the ram 430 after closing. Such sensor 500 detects flow noise generate by leakage in the first and second sealing elements 432-1, 432-2 and 434-1, 434-2 of the ram 430. In a specific embodiment, the acoustic sensor 500 may be a hydrophone. A pressure differential may exist between the uphole side 504 of the ram 430 and the downhole side 502, and thus a breach in the seal provided by the ram 430 may result in rapid fluid flow through a relatively confined area, creating screech, i.e., a vibration in the fluid within the BOP 332 in a certain acoustic frequency range. The acoustic sensor 500 may detect such screech and provide an indication thereof to the controller 490. In other embodiments, the acoustic sensor 500 may be above the ram 430, which may be low-pressure side thereof.

The assembly 354 may additionally or instead include one or more temperature sensors (three shown: 506, 508, 510). For example, the first temperature sensor 506 may be positioned on the downhole side 502 of the ram 430, near the ram 430. The second temperature sensor 508 may be positioned in the uphole side 504 of the ram 430. The third temperature sensor 510 may be positioned in the wellbore between the drill string 314 and the wellbore 301 (FIG. 3).

Fluid in the uphole side 504 may have a lower temperature than a temperature of fluid in the annulus, as well as fluid below the ram 430. Accordingly, the temperature T1 measured by the first temperature sensor 506 may be compared to the temperature T2 measured by the second temperature sensor 508 and the temperature T3 measured by the third temperature sensor 510. If the temperature T1 is cooler than the temperature T3 by a certain amount, or not higher than the temperature T2 by a certain amount, or both, the presence of a leak may be inferred. That is, the ingress of lower-temperature fluid from above the ram 430 may be detected based on the localized lower temperature near the ram 430. In other embodiments (e.g., where the low-pressure side is above the ram 430), an increase of the temperature T2 may indicate a leak in the ram system.

Figure 6:
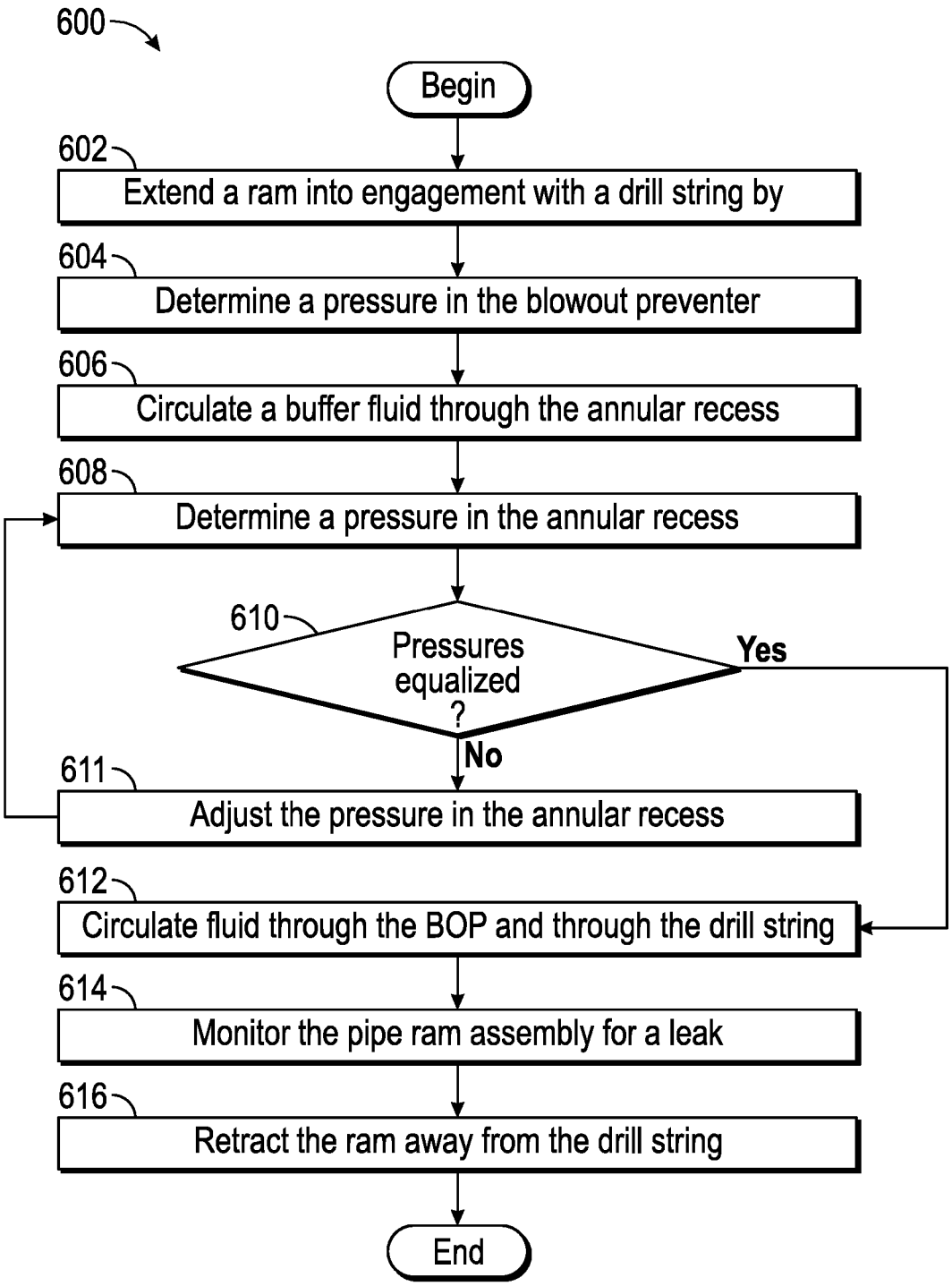
FIG. 6 illustrates a flowchart of a method for sealing a drill pipe within a blowout preventer, according to an embodiment.

FIG. 6 illustrates a flowchart of a method 600 for operating a pipe ram within a blowout preventer, according to an embodiment. The method 600 may be executed using one or more embodiments of the drilling system 300, and is thus described herein with reference thereto. In other embodiments, any other structure may be employed to execute the method 600, without departing from the scope of the present disclosure.

The method 600 may include extending the ram 430 into engagement with the drill string 314 by increasing the pressure in the first side 496A (or reducing pressure in the second side 496B) of the actuation chamber 496, as at 602. This may cause the ram 430 to be driven at least partially out of the first recess 454 into the extended position and into engagement with the drill string 314, if present. In some embodiments, the ram 430 may seal with the drill string 314 and/or may transmit the weight of the drill string 314 to the BOP body 452. This process of extending the ram 430 into engagement with the drill string 314 may be referred to as "closing" the pipe ram assembly 354.

The pressure in the BOP 332 (e.g., as experienced by the ram 430 and the tubular therein) may be determined, as at 604, e.g., via direct measurement, such as by the pressure sensor 492 (FIG. 4A). The method 600 may also include circulating a buffer fluid through the annular recess 476 between the ram 430 and the body 452 of the BOP 332, as at 606. The buffer fluid may be introduced to the annular recess 476 as part of a fluid circuit of the buffer system 460, which may recycle at least a portion of the buffer fluid. The buffer fluid supplied via the buffer system 460 may be filtered, pressurized, and/or otherwise treated by the buffer system 460.

The method 600 may further include determining a pressure of the buffer fluid in the annular recess 476, as at 608. Such determination may be conducted by measuring a pressure of the buffer fluid in the supply line 461 upstream of the annular recess 476, e.g., between the first pump 464 and the buffer vessel 466. In other embodiments, the pressure of the buffer fluid may be measured elsewhere in the buffer system 460, and the pressure in the annular recess 476 may be inferred. Further, in some embodiments, the pressure of the buffer fluid in the annular recess 476 may be directly measured therein. The pressure of the buffer fluid in the annular recess 476 may be determined continuously or intermittently, before, during, or after any other actions of the method 600.

The method 600 may also include comparing the pressure in the BOP 332, determined at 604, with the pressure in the annular recess 476, determined at 606, to determine if the pressure of the buffer fluid in the annular recess 476 may be equalized or even slightly above the pressure of the fluid within the BOP 332. If the pressure is not at the desired level, the pressure in the annular recess 476 may be adjusted, as at 611. Such adjustment may proceed by adjusting one or more operating parameters of the first pump 464 of the buffer system 460. If the pressure is too high, it may be lowered by proper actuation of the control valve 467. The comparison and determination at 610 may be conducted intermittently or continuously, before, during or after any other action of the method 600.

As will be described in greater detail below, the method 600 and the pipe ram assembly 354 may be provided as part of a continuous-circulation system. For example, once the pipe ram assembly 354 is closed, a connection of the drill string 314 may be broken within the BOP 332. In the case of tripping-in (adding pipe to the drill string 314), the top drive 304 may be disconnected from the drill string 314 in the BOP 332, and then another pipe (or string of pipes) may be attached thereto and subsequently lowered. In the case of tripping-out, an upper-most pipe may be disconnected from the next subjacent pipe of the drill string 314, within the BOP 332, and then the top drive 304 may be reconnected with the drill string 314, so as to again lift a portion of the drill string 314 out of the wellbore.

In either tripping process, an open connection 323 of the drill string 314 may thus be located in the BOP 332 when the pipe ram assembly 354 is closed. The method 600 may thus include circulating drilling fluid through the BOP 332 and through the drill string 314, as at 612. Once the top drive 304 or a new pipe stand is connected to the drill string 314 (either case may be referred to as connecting a tubular to the drill string 314), such that the top drive 304 is prepared to support the weight of the drill string 314 and deliver mud thereto, the pipe ram assembly 354 may be opened, and prepared to re-engage the drill string 314 for the next cycle of the tripping process.

The method 600 may also include monitoring the pipe ram assembly 354 for a leak, as at 613. This may be accomplished using one or more of the sensors 500, 506, 508, 510, and/or others, e.g., as discussed above with reference to FIG. 5. If a leak is detected, an alarm signal may be sent via the controller 490 to an operator, or corrective action may otherwise be taken. The method 600 may also include retracting the ram 430 away from the drill string, as at 614. This may be referred to as "opening" the pipe ram assembly 354.

In some embodiments, the above-described systems and methods may be employed in flow-drilling operations. Briefly, wellbore pressure may be maintained at the level of the formation pressure by combining the hydrostatic pressure and the friction loss along the wellbore up to surface. However, while stopping the flow, the friction loss may disappear and the wellbore pressure may fall below the formation pressure so that formation fluid may start to move from the formation into the well-bore. If formation permeability is low, the influx rate may be low. The influx may be water, liquid hydrocarbon or gas. The influx moves upwards in the wellbore due to gravity as well as flow in the well when the pumps restart. When reaching the surface, the influx may be directed to the flowline if liquid. Gas influx may also be directed to the flowline when a rotary seal is used at the top of the well. Gas and some liquid hydrocarbon may be separated from the mud and sent to the flare stack for burning. This combination of underbalance drilling and a rotary seal, but without usage of in-line choke for the flow out of the well, is referred to as "flow-drilling". In such application, the BOP rams may be closed if the period without flow is extended, as the amount of influx may be too large. Moreover, the BOP ram may close multiple times per week during long period of no-flow condition.

Figure 7A:
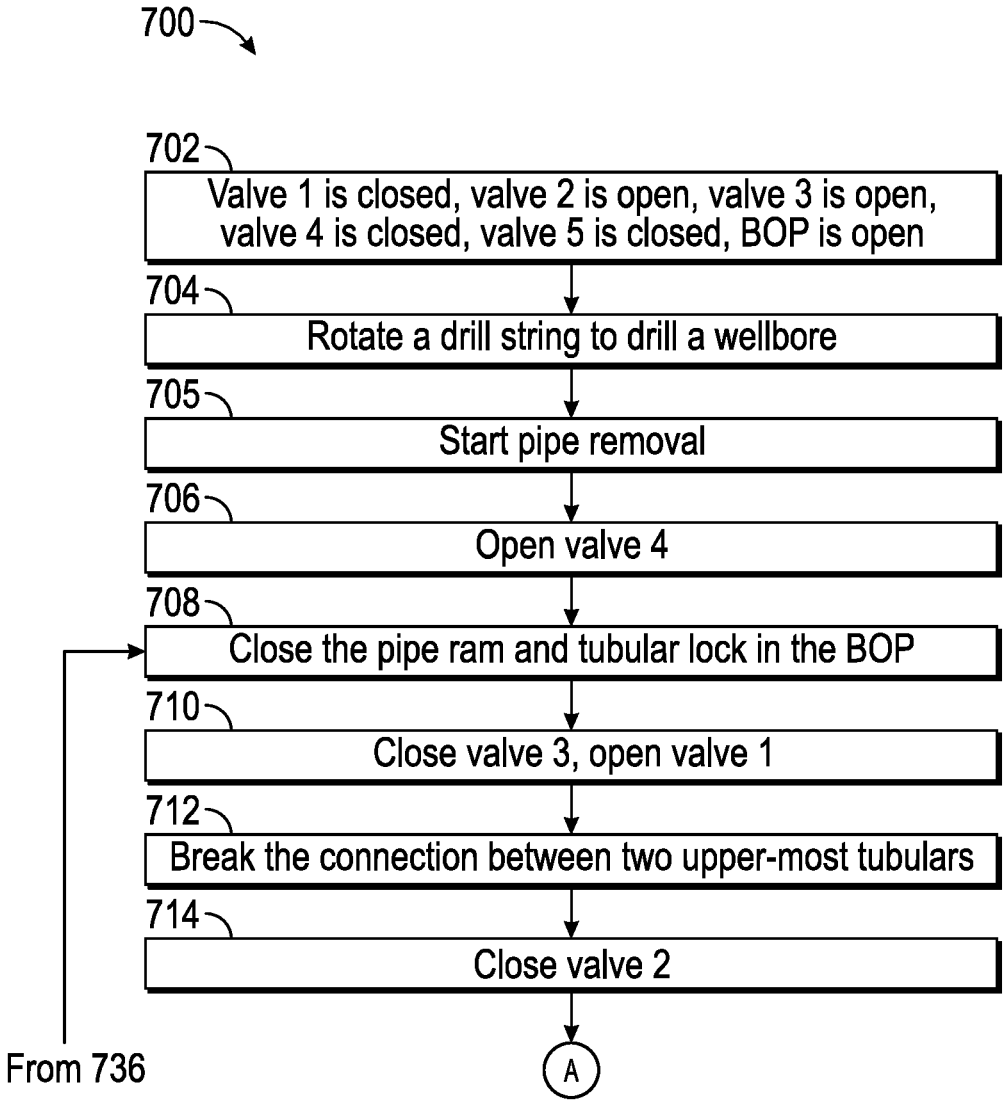
FIGS. 7A and 7B illustrate a flowchart of a method for drilling, according to an embodiment.
Figure 7B:
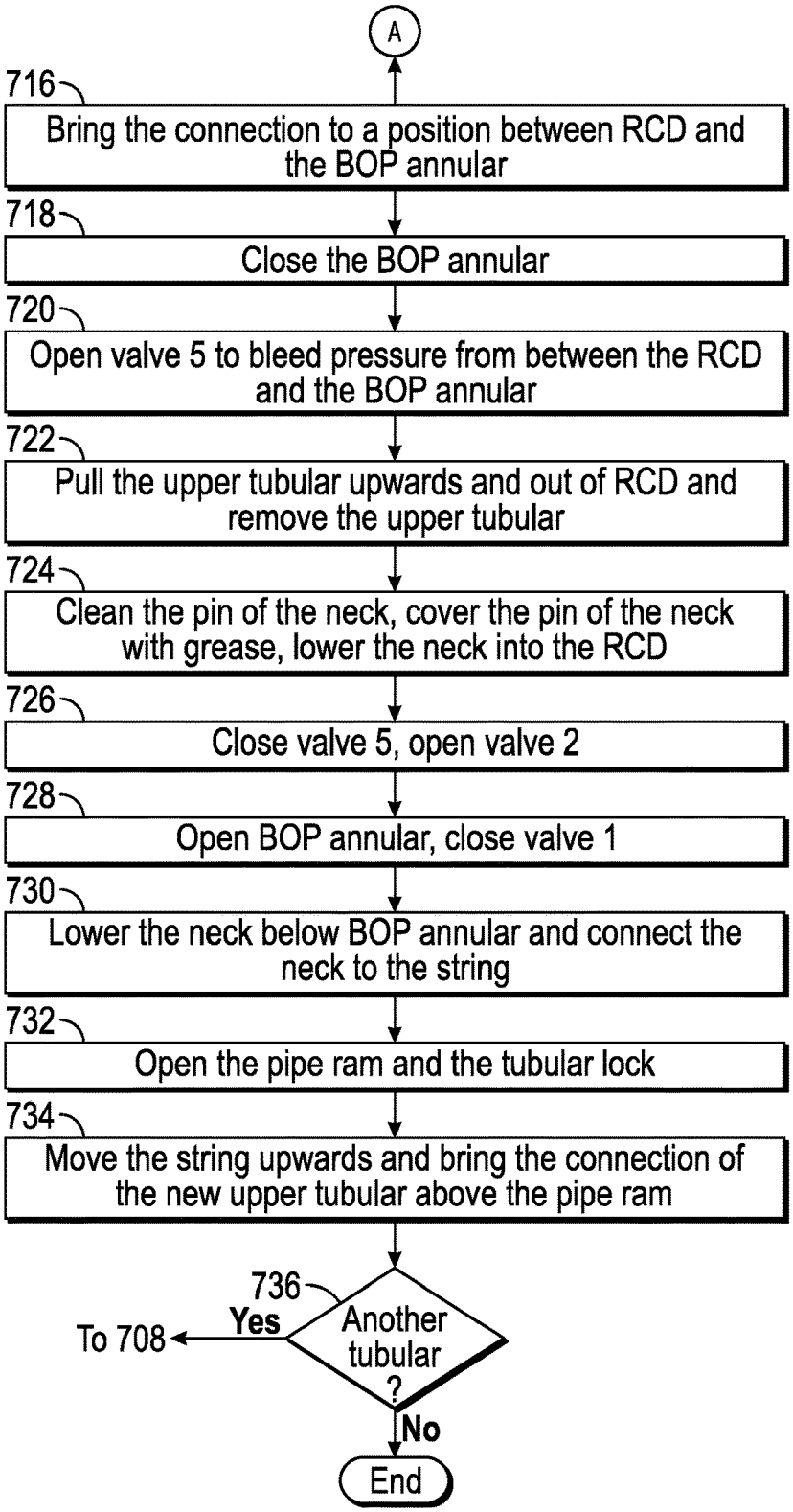

Referring now to FIGS. 7A and 7B, there is shown a flowchart of a method 700 for continuous mud circulation while drilling, according to an embodiment. The method 700 may employ an embodiment of the pipe ram assembly 354, e.g., that shown in FIGS. 3-5, although in other embodiments, other pipe rams may be used. The flowchart illustrates the method 700 beginning in a "normal" drilling configuration, although this starting point is not to be considered limiting, as the method 700 may start in any suitable configuration of the system 300 (or another system). In this instance, as indicated at 702, the first valve 402 may be closed, while the second valve 404 is open. As such, mud may be delivered from the mud pump 362 to the top drive 304 and downhole through the drill string 314. Further, the third valve 406 and the BOP annular 352 may be open, allowing mud circulated back through the wellhead 334 and the BOP 332 to be delivered to the choke 366 via the flow line 364. Further, the fourth and fifth valves 410 and 412 may be closed. That is, the first mud flow may be delivered to and received from the wellbore 301, while the second flow may be prevented. In this configuration, the method 700 may include rotating the drill string 314 to drill the wellbore 301, as at 704.

At some point, it may be desired to remove one or more tubulars of the drill string 314 from the wellbore 301, as indicated at 705. In such instances, the rotation of the drill string 314 may be stopped. Also, according to embodiments of the present method 700, when the drill string 314 is raised sufficiently, the upper-most tubular (or tubular set such as triple) 320 may be disconnected from the next tubular 321, and removed from the drill string 314 while continuing to circulate mud downhole. To accomplish this, the method 700 may include opening the fourth valve 410, as at 706, which may open the alternate flow line 408, directing some of the mud from the BOP 332 to the choke 366.

The method 700 may then proceed to closing the tubular lock 356 and the pipe ram assembly 354, as 708. As mentioned above, the tubular lock 356 may hold the drill string 314 in the BOP 332 and prevent the tubular 321 from rotating, while the pipe ram assembly 354 may generally seal the wellhead 334 from the BOP 332 above the pipe ram assembly 354. After closing the pipe ram assembly 354, the mud flow out of the wellbore 301 passes through the fourth valve 410 and flow line 408, e.g., to reach the choke 366.

As shown in 710, the method 700 may then include closing the third valve 406, and, e.g., thereafter, opening the first valve 402, to prepare the flow into the drill string 314 via the second or "alternate" path: however, at this point, the first flow into the drill string 314 may still be provided via the primary flow path (e.g., via line 322). In particular, this may initiate mud flow through the alternate mud supply line 400, and stop the return flow of mud via the fourth valve 410 and the flow line 408.

The method 700 may then proceed to breaking the connection 323 between the tubulars 320, 321, as at 712. In an embodiment, the top drive 304 may supply the torque to break out the connection 323, but in other embodiments, the system 300 may employ other structures or devices (e.g., tongs). Accordingly, in some embodiments, the make-up torque between at least some of the tubulars of the drill string 314 may or may not be configured to allow the top drive 304 to provide such torque. Breaking the connection 323 at 462 may allow for the initiation of the mud flow through the alternate mud supply line 400, while some mud flow may still be provided simultaneously by the mud supply line 322 (i.e., both the first and second mud flows may be at least partially active).

The method 700 may then include closing the second valve 404, as at 714, thereby stopping the first flow. Mud flow into the wellbore 301 may continue circulating via the alternate mud supply line 400 and the alternate flow line 408 (i.e., the second flow).

Further, the top drive 304 may remain capable of lifting the upper tubular 320. As such, the method 700 may include moving the lower connection 323 of the upper tubular 320 to a position above the BOP annular 352 and below the RCD seal 350, as at 716. The rest of the drill string 314 (below the broken connection 323) may stay held by the tubular lock 356 at the same position in the wellbore 301. The BOP annular 352 may then be closed, as at 468, so as to seal the BOP 332 below the lower connection 323 of the upper tubular 320. Next, pressure in the area between the RCD seal 350 and the BOP annular 352 may be bled, as at 720, e.g., via the bleed line 414, by opening the fifth valve 412.

At 722, the upper tubular 320 (above the broken connection 323) may then be moved upwards, until its lower end (i.e., previously part of the connection 323) is pulled out of the RCD 330. The tubular 320 may be removed after being disconnected from the neck 318. As at 724, with the tubular 320 removed, the pin of the neck 318 is cleaned and covered with a layer of grease. Additional details regarding the application of grease to the neck 318 are provided below, with reference to FIG. 7. As also indicated at 724, the neck 318 of the shaft 316 may be lowered past the RCD seal 350 and into the RCD 330, e.g., after the grease is applied.

The fifth valve 412 may then be closed, and the pressure inside the RCD 330 may be equilibrated in comparison with the pressure below the BOP annular 352 by opening the second valve 404, as at 726. Then the BOP annular 352 may be opened, as at 728, followed by the closing of the first valve 402 to avoid to washing away the grease on the pin of the neck 318.

As shown at 730, the neck 318 may be lowered below the BOP annular 352, and may then be connected with the drill string 314. The method 700 may also include resuming the first flow of mud, through the top drive 304. Make-up torque may be applied via the top drive 304, while the reaction torque is transmitted to the tubular lock 356. The method 700 may also opening the pipe ram assembly 354 and the tubular lock 356, as at 732. Then the drill string 314 may be moved upwards so the lower connection 323 of the new upper joint is above the pipe ram assembly 354 and tubular lock 356, as at 734. The method 700 may then include determining whether another joint is to be removed, as at 736. If another joint is to be removed, the method 700 may loop back to 708, and begin proceeding back through the subsequent blocks.

Figure 8A:
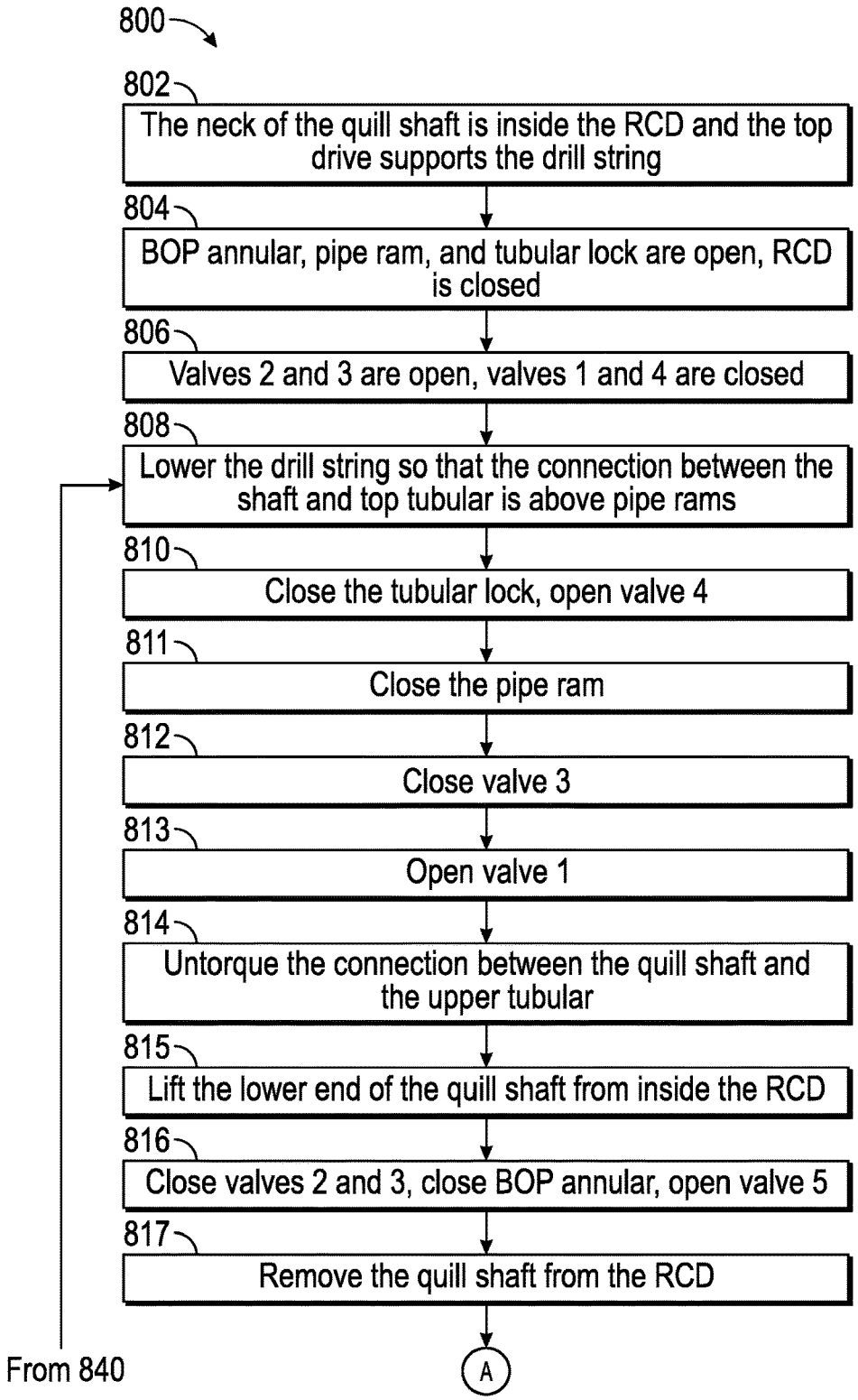
FIGS. 8A and 8B illustrate a flowchart of another method for drilling, according to an embodiment.
Figure 8B:
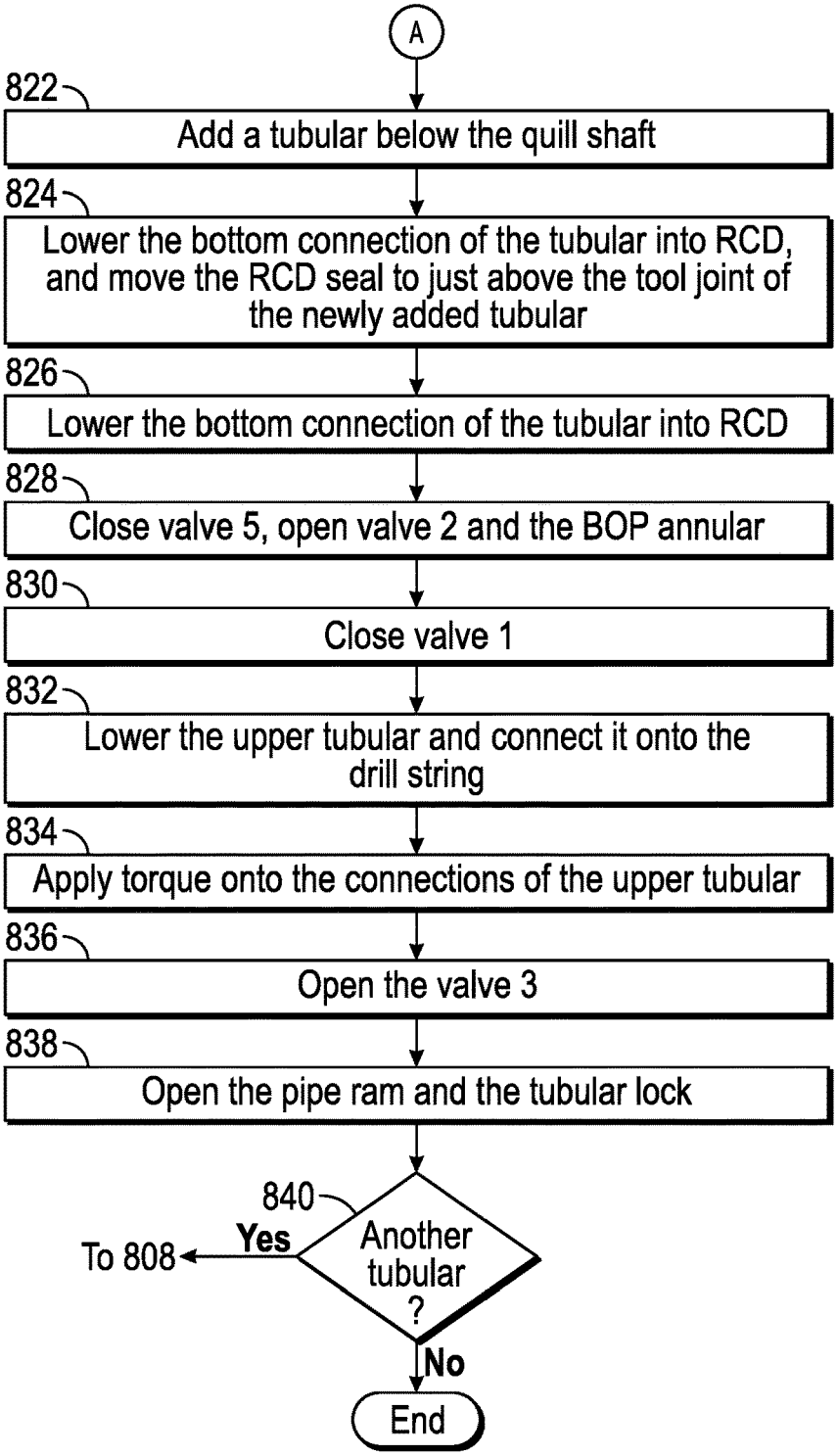

FIGS. 8A and 8B illustrate a flowchart of a method 800 for continuous circulation during a drilling process, such as trip-in, according to an embodiment. The method 800 may be executed using an embodiment of the pipe ram assembly 354 discussed above, but in other embodiments, other pipe rams may be employed. The initial condition of the system 300 at the start of the method 800, according to an embodiment, is as indicated at 802, with the drill string 314 connected to and supported by the top drive 304, via connection with the shaft 316 thereof, and the neck 318 of the quill shaft 316 positioned inside of the RCD 330. Further, in an embodiment, mud pumping may have been occurring prior to the start of the method 800. Accordingly, the BOP annular 352, pipe ram assembly 354, and tubular lock 356 may be open, while the RCD seal 350 may be engaged with the shaft 316 or the drill string 314, thereby sealing the wellbore 301, as at 804.

Further, as indicated at 806, the second and third valves 404, 406 may be open, allowing for the mud delivered by the pump 362 to flow through the primary flow path (e.g., via lines 322 and 364). Correspondingly, the first and fourth valves 402, 410 may be closed, blocking the second flow.

The method 800 may include lowering the drill string 314 by lowering the top drive 304, until the shaft 316 is pushed into the BOP 332, such that the connection between the upper tubular 320 and shaft 316 is situated immediately above the pipe ram assembly 354, as at 808. The tubular lock 356 may then be closed onto the drill string 314, and the fourth valve 410 may be opened, as at 810. Further, the pipe ram assembly 354 may be closed, as at 811, the third valve 406 may be closed, as at 812, and the first valve 402 may be opened, as at 813.

The connection between the upper pipe and the shaft 316 may then be disconnected, as at 814. During this transition period, mud flow from the pump 362 may enter the drill string 314 according to the primary flow path, via the line 322 and the top drive 304, and via the secondary flow path, via the mud supply line 400.

The top drive 304 may be moved upwards to bring the lower connection of the shaft 316 inside the RCD 330, as at 815. As indicated at 816, the second and third valves 404, 406 may then be closed, along with the BOP annular 352. The mud flow delivered by the pump 362 is still active via the alternate mud supply line 400, and back, e.g., to the choke 366, which may be fully open, via the flow line 408. Finally, the fifth valve 412 may be opened to bleed the pressure inside the RCD 330.

The shaft 316 may then be removed from the RCD 330, e.g., by lifting the top drive 304, as at 817. Further, in an embodiment, the RCD seal 350, which may include a bearing assembly, may be disengaged from a body of the RCD 330, such that the RCD seal 350 travels upwards with the shaft 316 as the top drive 304 is lifted, and thus is moved to a location above the rig floor 470 e.g., by the RCD seal locator 416, while the RCD seal 350 is still on the shaft 316.

As at 822, the new tubular 320 is connected to shaft 316 the top drive 304. Next, at 824, the RCD seal 350 is moved to a position (slightly) above the lower connection of the newly added tubular 320. At 826, the top drive 304 moves downwards so that the lower connection of the newly added tubular 320 is pushed into the RCD 330, until the lower connection 323 of the new tubular 320 is above the BOP annular 352 (which is closed). The RCD seal 350 (with its bearing assembly) is re-engaged in the RCD 330 and it is latched in place.

At 828, the fifth valve 412 may be closed. Further, the second valve 404 may be opened to equalize the pressure across the BOP annular 352, and then the BOP annular 352 may be opened. Then the first valve 402 may be closed, as at 830. The upper tubular 320 may then be lowered by moving the top drive 304 downward, until its lower connection is engaged in the upper connection of the drill string 314 in the BOP 332, so that the connection with drill string 314 is made, as at 832. Torque is applied at 834, e.g., by the top drive 304 onto the upper tubular 320 so that the connections at both extremities may be torqued to a predetermined amount. The tubular lock 356 may ensure back-up torque is provided.

The method 800 may also include opening the third valve 406 to balance the pressure across the pipe ram assembly 354, as at 836. The method 800 may then include opening the pipe ram assembly 354 and the tubular lock, as at 838. The method 800 may then proceed to determining whether another tubular joint is to be added, as at 840. If another tubular is to be added, the method 800 may return to block 808. Otherwise, the method 800 may end and subsequent tasks, which may include continued pumping, may be performed. Drilling may also be engaged.

Figure 9:
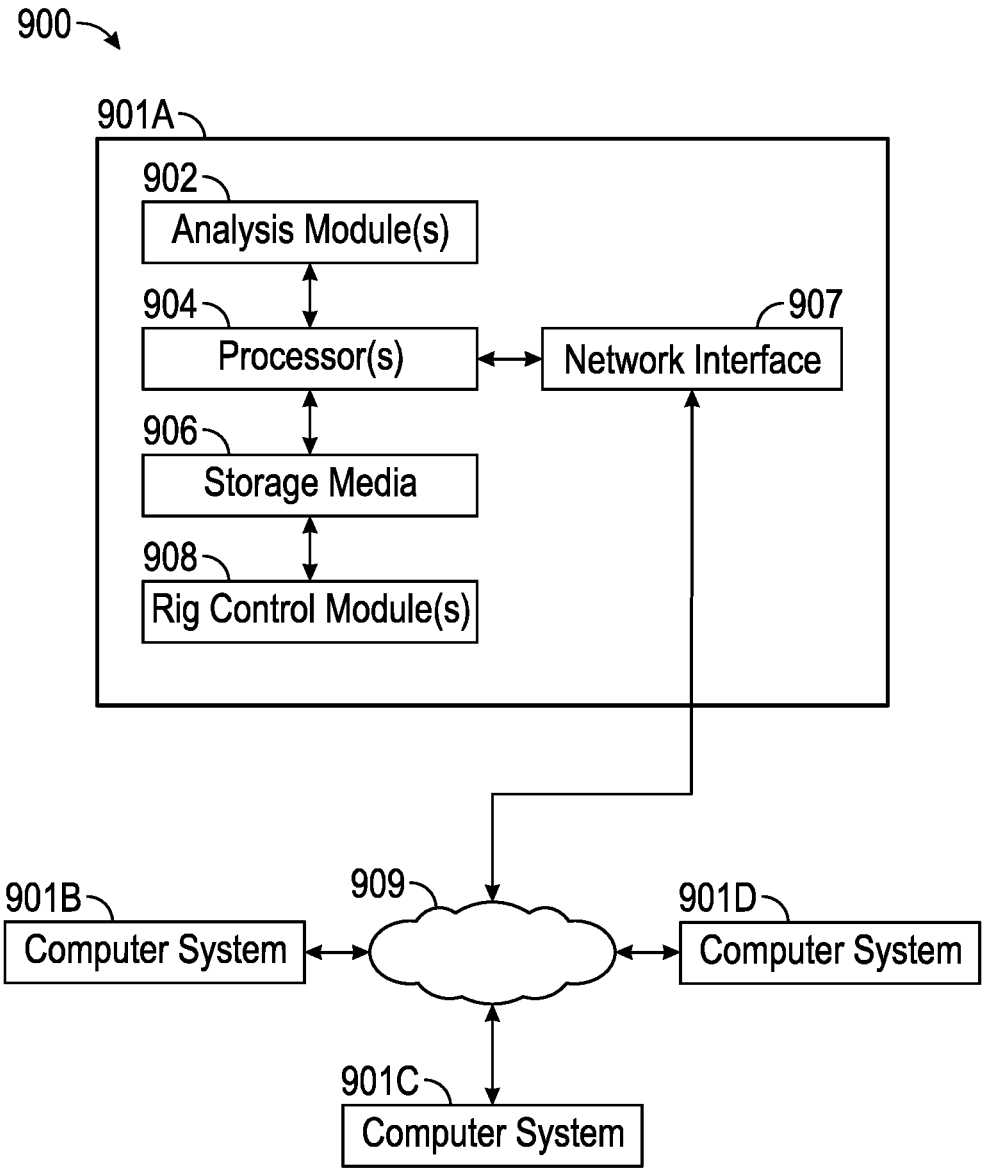
FIG. 9 illustrates a schematic view of a computing system, according to an embodiment.

In some embodiments, the methods of the present disclosure may be executed by a computing system. FIG. 9 illustrates an example of such a computing system 900, in accordance with some embodiments. The computing system 900 may include a computer or computer system 901A, which may be an individual computer system 901A or an arrangement of distributed computer systems. The computer system 901A includes one or more analysis modules 902 that are configured to perform various tasks according to some embodiments, such as one or more methods disclosed herein. To perform these various tasks, the analysis module 902 executes independently, or in coordination with, one or more processors 904, which is (or are) connected to one or more storage media 906. The processor(s) 904 is (or are) also connected to a network interface 907 to allow the computer system 901A to communicate over a data network 909 with one or more additional computer systems and/or computing systems, such as 901B, 901C, and/or 901D (note that computer systems 901B, 901C and/or 901D may or may not share the same architecture as computer system 901A, and may be located in different physical locations, e.g., computer systems 901A and 901B may be located in a processing facility, while in communication with one or more computer systems such as 901C and/or 901D that are located in one or more data centers, and/or located in varying countries on different continents).

A processor may include a microprocessor, microcontroller, processor module or subsystem, programmable integrated circuit, programmable gate array, or another control or computing device.

The storage media 906 may be implemented as one or more computer-readable or machine-readable storage media. Note that while in the example embodiment of FIG. 9 storage media 906 is depicted as within computer system 901A, in some embodiments, storage media 906 may be distributed within and/or across multiple internal and/or external enclosures of computing system 901A and/or additional computing systems. Storage media 906 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLU-RAY® disks, or other types of optical storage, or other types of storage devices. Note that the instructions discussed above may be provided on one computer-readable or machine-readable storage medium, or alternatively, may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, the computing system 900 contains one or more mixer control module(s) 908. In the example of computing system 900, computer system 901A includes the mixer control module 908. In some embodiments, a single mixer control module may be used to perform some or all aspects of one or more embodiments of the methods disclosed herein. In alternate embodiments, a plurality of mixer control modules may be used to perform some or all aspects of methods herein.

It should be appreciated that computing system 900 is only one example of a computing system, and that computing system 900 may have more or fewer components than shown, may combine additional components not depicted in the example embodiment of FIG. 9, and/or computing system 900 may have a different configuration or arrangement of the components depicted in FIG. 9. The various components shown in FIG. 9 may be implemented in hardware, software, or a combination of both hardware and software, including one or more signal processing and/or application specific integrated circuits.

Further, the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of protection of the invention.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to explain at least some of the principals of the disclosure and their practical applications, to thereby enable others skilled in the art to utilize the disclosed methods and systems and various embodiments with various modifications as are suited to the particular use contemplated.

What is claimed is:

1. A blowout preventer, comprising:

a body defining a ram recess and an annular recess, the ram recess and the annular recess being separated apart;

a ram positioned at least partially in the ram recess and movable with respect to the body, the ram comprising a distal end configured to engage a tubular and a proximal end positioned within the ram recess;

an actuation assembly comprising an actuation chamber, the annular recess being positioned between the actuation chamber and the ram recess wherein the actuation assembly includes a rod connected to the ram such that the ram is movable by movement of the rod and in a direction transverse relative to a longitudinal axis of the rod, a housing defining the actuation chamber, and a piston disposed in the actuation chamber; and a buffer supply system configured to circulate a buffer fluid through the annular recess, to prevent leakage of fluid from the ram recess into the actuation chamber;

a first seal positioned on a first side of the annular recess and configured to seal with the rod, and a second seal positioned on a second side of the annular recess and configured to seal with the rod, wherein the first seal comprises v-packing, the blowout preventer further comprising a support body that compresses the v-packing against the body or a ring, and a retainer that adjustably engages the support body, to change a compression of the v-packing.

2. A blowout preventer, comprising:

a body defining a ram recess and an annular recess, the ram recess and the annular recess being separated apart;

a ram positioned at least partially in the ram recess and movable with respect to the body, the ram comprising a distal end configured to engage a tubular and a proximal end positioned within the ram recess;

an actuation assembly comprising an actuation chamber, the annular recess being positioned between the actuation chamber and the ram recess; and a buffer supply system configured to circulate a buffer fluid through the annular recess, to prevent leakage of fluid from the ram recess into the actuation chamber wherein the ram comprises:

a first sealing element that is configured to seal with the tubular;

a high-pressure side and a low-pressure side;

a second sealing element on the low pressure side that is configured to seal with the body in the recess;

a lift piston extending from the low-pressure side, wherein the lift piston is configured to push the low-pressure side of the ram away from the body in the ram recess; and the actuation assembly comprises a rod connected to the ram, such that linear movement of the rod is transmitted to the ram;

the ram defines a slot extending from the high-pressure side; and the ram comprises a first block positioned in the slot and coupled to the rod, and a second block positioned in the slot and in engagement with the first block, and wherein the first block and the second block are forced in opposite directions by rotation of the rod, such that the first block extends out of the slot and forces the low-pressure side of the ram towards the body in the ram recess.

3. A blowout preventer, comprising:

a body defining a ram recess and an annular recess, the ram recess and the annular recess being separated apart;

a ram positioned at least partially in the ram recess and movable with respect to the body, the ram comprising a distal end configured to engage a tubular and a proximal end positioned within the ram recess;

an actuation assembly comprising an actuation chamber, the annular recess being positioned between the actuation chamber and the ram recess; and a buffer supply system configured to circulate a buffer fluid through the annular recess, to prevent leakage of fluid from the ram recess into the actuation chamber wherein the ram comprises:

a first sealing element that is configured to seal with the tubular;

a high-pressure side and a low-pressure side;

a second sealing element on the low pressure side that is configured to seal with the body in the recess;

a lift piston extending from the low-pressure side, wherein the lift piston is configured to push the low-pressure side of the ram away from the body in the ram recess; and wherein the ram defines grooves on the low-pressure side, and wherein the body of the blowout preventer defines openings therein, wherein the openings are aligned with the low-pressure side, between the grooves, and wherein the openings are configured to deliver a lubricating fluid to the ram recess, between the body and the low-pressure side of the ram, and between the grooves.

4. A blowout preventer, comprising:

a body defining a ram recess and an annular recess, the ram recess and the annular recess being separated apart;

a ram positioned at least partially in the ram recess and movable with respect to the body, the ram comprising a distal end configured to engage a tubular and a proximal end positioned within the ram recess;

an actuation assembly comprising an actuation chamber, the annular recess being positioned between the actuation chamber and the ram recess; and a buffer supply system configured to circulate a buffer fluid through the annular recess, to prevent leakage of fluid from the ram recess into the actuation chamber wherein the ram comprises:

a first sealing element that is configured to seal with the tubular;

a high-pressure side and a low-pressure side;

a second sealing element on the low pressure side that is configured to seal with the body in the recess;

a lift piston extending from the low-pressure side, wherein the lift piston is configured to push the low-pressure side of the ram away from the body in the ram recess; and wherein the ram defines grooves in the high-pressure side, and wherein the body defines openings therein that are aligned with the ram between the grooves, so as to deliver a fluid to the ram recess between the grooves.

5. A blowout preventer, comprising:

a body defining a ram recess and an annular recess, the ram recess and the annular recess being separated apart;

a ram positioned at least partially in the ram recess and movable with respect to the body, the ram comprising a distal end configured to engage a tubular and a proximal end positioned within the ram recess;

an actuation assembly comprising an actuation chamber, the annular recess being positioned between the actuation chamber and the ram recess;

a buffer supply system configured to circulate a buffer fluid through the annular recess, to prevent leakage of fluid from the ram recess into the actuation chamber; and at least one sensor configured to detect leakage across the ram when the ram engages the tubular.

6. The blowout preventer of claim 5, wherein the at least one sensor comprises an acoustic sensor configured to detect a vibration caused by leakage within the blowout preventer.

7. The blowout preventer of claim 6, wherein the at least one sensor comprises a plurality of temperature sensors, a first one of the plurality of temperature sensors being positioned on a downhole side of the ram, and a second one of the plurality of temperature sensors being positioned in a wellbore annulus.

8. A method for drilling, comprising:

closing a pipe ram assembly in a blowout preventer by adjusting a pressure in an actuation chamber, such that a ram of the ram assembly moves into engagement with a drill string;

breaking a connection of the drill string within the blowout preventer, wherein a weight of the drill string is supported by the pipe ram assembly after breaking the connection;

circulating drilling mud through the blowout preventer and the drill string, after breaking the connection;

connecting a tubular to the connection of the drill string within the blowout preventer; and opening the pipe ram assembly such that the ram retracts away from the drill string and sensing leakage across the ram in the blowout preventer when the ram is engaged with the drill string.

9. The method of claim 8, wherein sensing leakage comprises sensing a vibration caused by leakage between the ram and the drill string.

10. The method of claim 9, wherein sensing leakage comprises determining that a temperature in a fluid on a downhole side of the ram is lower than a temperature in a fluid in a wellbore annulus by an amount that is greater than a threshold.

11. A blowout preventer, comprising:

a body defining a ram recess; and a ram positioned at least partially in the ram recess and movable with respect to the body, the ram comprising:

a distal end configured to engage a tubular;

a proximal end positioned within the ram recess, a first sealing element at the distal end that is configured to seal with the tubular;

a high-pressure side and a low-pressure side that both extend between the proximal and distal ends;

a second sealing element on the low pressure side that is configured to seal with the body in the recess; and a lift piston extending from the low-pressure side, wherein the lift piston is configured to push the low-pressure side of the ram away from the body in the ram recess and an actuation assembly configured to move the ram with respect to the body, wherein:

the actuation assembly comprises a rod connected to the ram, such that linear movement of the rod is transmitted to the ram;

the ram defines a slot extending from the high-pressure side;

the ram further comprises a first block positioned in the slot and coupled to the rod, and a second block positioned in the slot and in engagement with the first block; and the first block and the second block are forced in opposite directions by rotation of the rod, such that the first block extends out of the slot and forces the low-pressure side of the ram towards the body in the ram recess.

12. A blowout preventer, comprising:

a body defining a ram recess; and a ram positioned at least partially in the ram recess and movable with respect to the body, the ram comprising:

a distal end configured to engage a tubular;

a proximal end positioned within the ram recess, a first sealing element at the distal end that is configured to seal with the tubular;

a high-pressure side and a low-pressure side that both extend between the proximal and distal ends;

a second sealing element on the low pressure side that is configured to seal with the body in the recess; and a lift piston extending from the low-pressure side, wherein the lift piston is configured to push the low-pressure side of the ram away from the body in the ram recess and wherein the ram defines grooves on the low-pressure side, and wherein the body defines openings therein that are aligned with the low-pressure side, between the grooves, and wherein the openings are configured to deliver a lubricating fluid to the ram recess, between the body and the low-pressure side of the ram, and between the grooves.

13. A blowout preventer, comprising:

a body defining a ram recess; and a ram positioned at least partially in the ram recess and movable with respect to the body, the ram comprising:

a distal end configured to engage a tubular;

a proximal end positioned within the ram recess, a first sealing element at the distal end that is configured to seal with the tubular;

a high-pressure side and a low-pressure side that both extend between the proximal and distal ends;

a second sealing element on the low pressure side that is configured to seal with the body in the recess; and a lift piston extending from the low-pressure side, wherein the lift piston is configured to push the low-pressure side of the ram away from the body in the ram recess and wherein the ram defines grooves in the high-pressure side, and wherein the body defines openings therein that are aligned with the ram between the grooves, so as to deliver a fluid to the ram recess between the grooves.

* * * * *